US011877620B2

(12) United States Patent
Campos, II et al.

(10) Patent No.: US 11,877,620 B2
(45) Date of Patent: Jan. 23, 2024

(54) SOLE STRUCTURE FOR ARTICLE OF FOOTWEAR

(71) Applicant: NIKE, Inc., Beaverton, OR (US)

(72) Inventors: Fidencio Campos, II, Dallas, OR (US); Zachary M. Elder, Portland, OR (US); Jordyn Klumpp, Portland, OR (US); Eric Y. Lee, Beaverton, OR (US); Fiona L Lesecq, Beaverton, OR (US); Damian R. Manspeaker, Beaverton, OR (US); Roger Paul Murphy, Beaverton, OR (US); Sebastian Tesche, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 147 days.

(21) Appl. No.: 17/330,333

(22) Filed: May 25, 2021

(65) Prior Publication Data

US 2021/0368921 A1 Dec. 2, 2021

Related U.S. Application Data

(60) Provisional application No. 63/032,690, filed on May 31, 2020.

(51) Int. Cl.
*A43B 13/20* (2006.01)
*A43B 13/18* (2006.01)

(52) U.S. Cl.
CPC ..... *A43B 13/20* (2013.01); *A43B 13/186* (2013.01)

(58) Field of Classification Search
CPC ..... A43B 13/20; A43B 13/18; A43B 13/185; A43B 13/186
USPC ..... 36/29
See application file for complete search history.

(56) References Cited

U.S. PATENT DOCUMENTS 4,616,431 A * 10/1986 Dassler ..... A43B 13/181 36/28
5,092,060 A * 3/1992 Frachey ..... A43B 21/28 36/114
5,343,639 A * 9/1994 Kilgore ..... A43B 13/183 36/35 B (Continued)

OTHER PUBLICATIONS

European Patent Office, PCT International Search Report/Written Opinion for application PCT/US2021/034149 dated Aug. 27, 2021.

*Primary Examiner* — Marie D Bays
(74) *Attorney, Agent, or Firm* — Honigman LLP; Matthew H. Szalach; Jonathan P. O'Brien

(57) ABSTRACT

A sole structure for an article of footwear includes a chassis and a cushioning arrangement. The chassis includes a recess formed between a first surface and a second surface facing the first surface. The cushioning arrangement includes a first cushioning element protruding from the first surface and including a first plurality of lobes and a second cushioning element protruding from the second surface and including a second plurality of lobes contacting the first plurality of lobes. At least one of the first cushioning element and the second cushioning element may include a fluid-filled bladder. A first side of each cushioning element includes a substantially planar base and a second side of each cushioning element includes the lobes formed on an opposite side from the base. The base of each cushioning element is attached to a respective one of the surfaces of the recess.

16 Claims, 25 Drawing Sheets

(56) References Cited

U.S. PATENT DOCUMENTS 5,901,467 A * 5/1999 Peterson ..... A43B 13/20 36/35 B
6,029,962 A * 2/2000 Shorten ..... B29C 51/267 267/145
6,402,879 B1 * 6/2002 Tawney ..... A43B 13/20 36/35 R
6,487,796 B1 * 12/2002 Avar ..... A43B 13/182 36/114
7,877,898 B2 * 2/2011 Aveni ..... A43B 13/183 36/35 R
2003/0208929 A1 * 11/2003 Lucas ..... A43B 7/145 36/27
2004/0194347 A1 * 10/2004 Aveni ..... A43B 7/1464 36/91
2005/0028403 A1 2/2005 Swigart et al.
2005/0133968 A1 * 6/2005 Foxen ..... A43B 21/28 264/255
2007/0033831 A1 * 2/2007 Aveni ..... A43B 21/26 36/27
2007/0277396 A1 * 12/2007 Swigart ..... A43B 21/26 36/27
2008/0184595 A1 * 8/2008 Schindler ..... A43B 3/0036 36/35 B
2009/0100705 A1 * 4/2009 Cook ..... A43B 13/026 36/28
2010/0107444 A1 * 5/2010 Aveni ..... A43B 13/189 36/35 B
2012/0304501 A1 * 12/2012 Song ..... B29D 35/122 36/25 R
2014/0075777 A1 * 3/2014 Bruce ..... A43B 7/148 36/29
2015/0033577 A1 * 2/2015 Dahl ..... A43B 13/20 12/146 B
2017/0035146 A1 * 2/2017 Peyton ..... A43B 13/20
2018/0213886 A1 * 8/2018 Connell ..... A43B 13/125
2020/0154826 A1 5/2020 Case et al.
2020/0245718 A1 * 8/2020 Lesecq ..... A43B 13/20
2021/0030112 A1 * 2/2021 Amoako ..... A43B 13/20

* cited by examiner

SOLE STRUCTURE FOR ARTICLE OF FOOTWEAR

CROSS REFERENCE TO RELATED APPLICATIONS

This application claims priority under 35 U.S.C. § 119(e) to U.S. Provisional Application 63/032,690, filed on May 31, 2020. The disclosure of this prior application is considered part of the disclosure of this application and is hereby incorporated by reference in its entirety.

FIELD

The present disclosure relates generally to sole structures for articles of footwear, and more particularly, to sole structures incorporating a bladder.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally or alternatively incorporate a fluid-filled bladder to provide cushioning to the foot by compressing resiliently under an applied load to attenuate ground-reaction forces. Sole structures may also include a comfort-enhancing insole or a sockliner located within a void proximate to the bottom portion of the upper and a strobel attached to the upper and disposed between the midsole and the insole or sockliner.

Midsoles employing bladders typically include a bladder formed from two barrier layers of polymer material that are sealed or bonded together. The bladders may contain air, and are designed with an emphasis on balancing support for the foot and cushioning characteristics that relate to responsiveness as the bladder resiliently compresses under an applied load.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1:
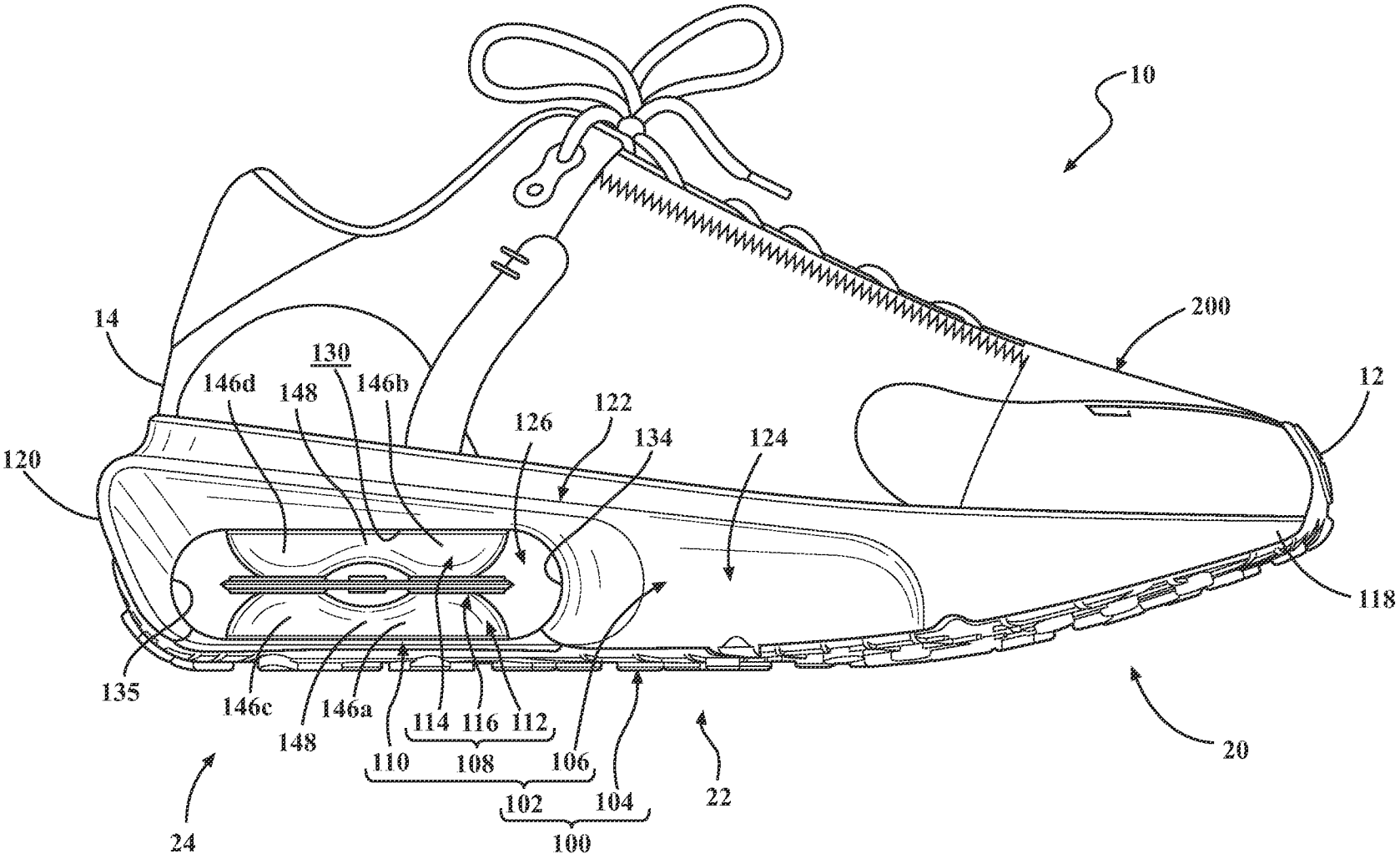
FIG. 1 is a lateral side elevation view of an article of footwear including a sole structure in accordance with the principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

One aspect of the disclosure provides a sole structure for an article of footwear. The sole structure includes a chassis having a recess formed between a first surface and a second surface facing the first surface. The sole structure also includes a cushioning arrangement including a first cushioning element protruding from the first surface and including a plurality of lobes and a second cushioning element protruding from the second surface to a distal end contacting the plurality of lobes. Implementations of the disclosure may include one or more of the following optional features.

In some examples, the first cushioning element includes a bladder.

In some implementations, a first side of the first cushioning element includes a substantially planar base and a second side of the first cushioning element includes the plurality of lobes formed on an opposite side from the base. In some configurations, lobes of the plurality of lobes are arranged in a quad-shaped configuration.

In some examples, each lobe of the plurality of lobes is hemispherical.

In some configurations, the first surface includes a first socket receiving a first end of the cushioning arrangement including the first cushioning element.

In some examples, the sole structure includes a cradle defining the first surface of the recess, the cradle including a harder material than the chassis. In some implementations, a length of the recess extends between a first concave end and a second concave end.

In some examples, the sole structure has a support plate disposed between the first cushioning element and the second cushioning element and including a plurality of receptacles receiving the plurality of lobes of the first cushioning element. Here, the support plate includes a material having a greater hardness than each of the first cushioning element and the second cushioning element.

Another aspect of the disclosure provides a sole structure for an article of footwear. The sole structure has a chassis including a recess formed between a first surface and a second surface facing the first surface. The sole structure also has a cushioning arrangement including a first cushioning element protruding from the first surface and including a first plurality of lobes, and a second cushioning element protruding from the second surface and including a second plurality of lobes contacting the first plurality of lobes. Implementations of the disclosure may include one or more of the following optional features.

In some examples, at least one of the first cushioning element and the second cushioning element includes a fluid-filled bladder.

In some implementations, a first side of the first cushioning element includes a substantially planar first base and the second cushioning element includes a substantially planar second base. Here, the first plurality of lobes is disposed on an opposite side of the first cushioning element than the substantially planar first base and the second plurality of lobes is disposed on an opposite side of the second cushioning element than the substantially planar second base.

In some examples, lobes of the first plurality of lobes and lobes of the second plurality of lobes are arranged in a quad-shaped configuration.

In some implementations, each lobe of the first plurality of lobes and each lobe of the second plurality of lobes is hemispherical.

In some configurations, the first surface includes a first socket receiving the first cushioning element and the second surface includes a second socket receiving the second cushioning element.

In some examples, the sole structure includes a cradle defining the first surface of the recess, the cradle including a harder material than the chassis.

In some configurations, a length of the recess extends between a first concave end and a second concave end.

In some examples, the sole structure includes a support plate disposed between the first cushioning element and the second cushioning element and including a plurality of receptacles receiving lobes of the first cushioning element and lobes of the second cushioning element. Here, the support plate includes a material having a greater hardness than each of the first cushioning element and the second cushioning element.

The details of one or more implementations of the disclosure are set forth in the accompanying drawings and the description below. Other aspects, features, and advantages will be apparent from the description and drawings, and from the claims.

Figure 3:
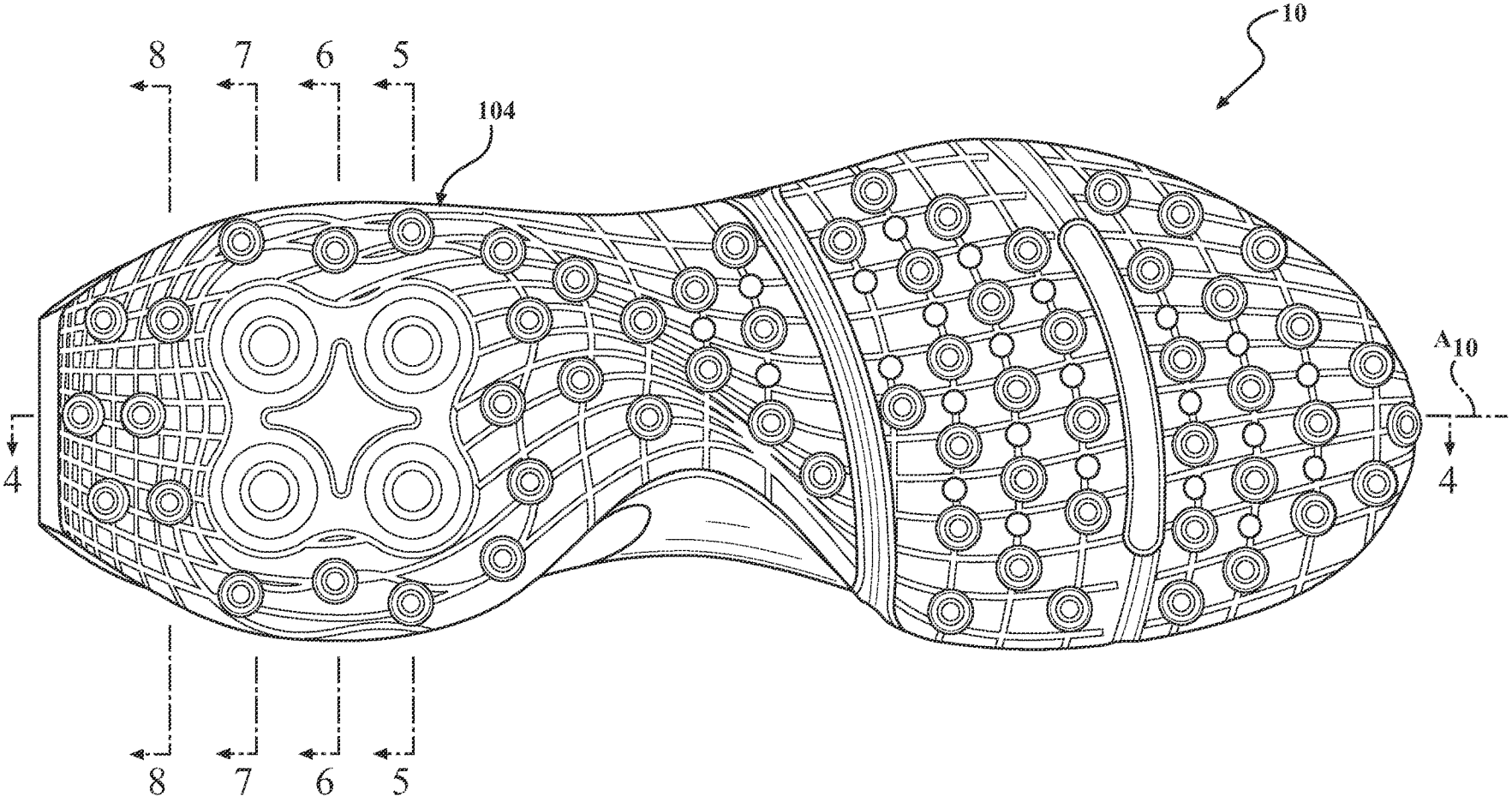
FIG. 3 is a bottom plan view of the article of footwear of FIG. 1.
Figure 4:
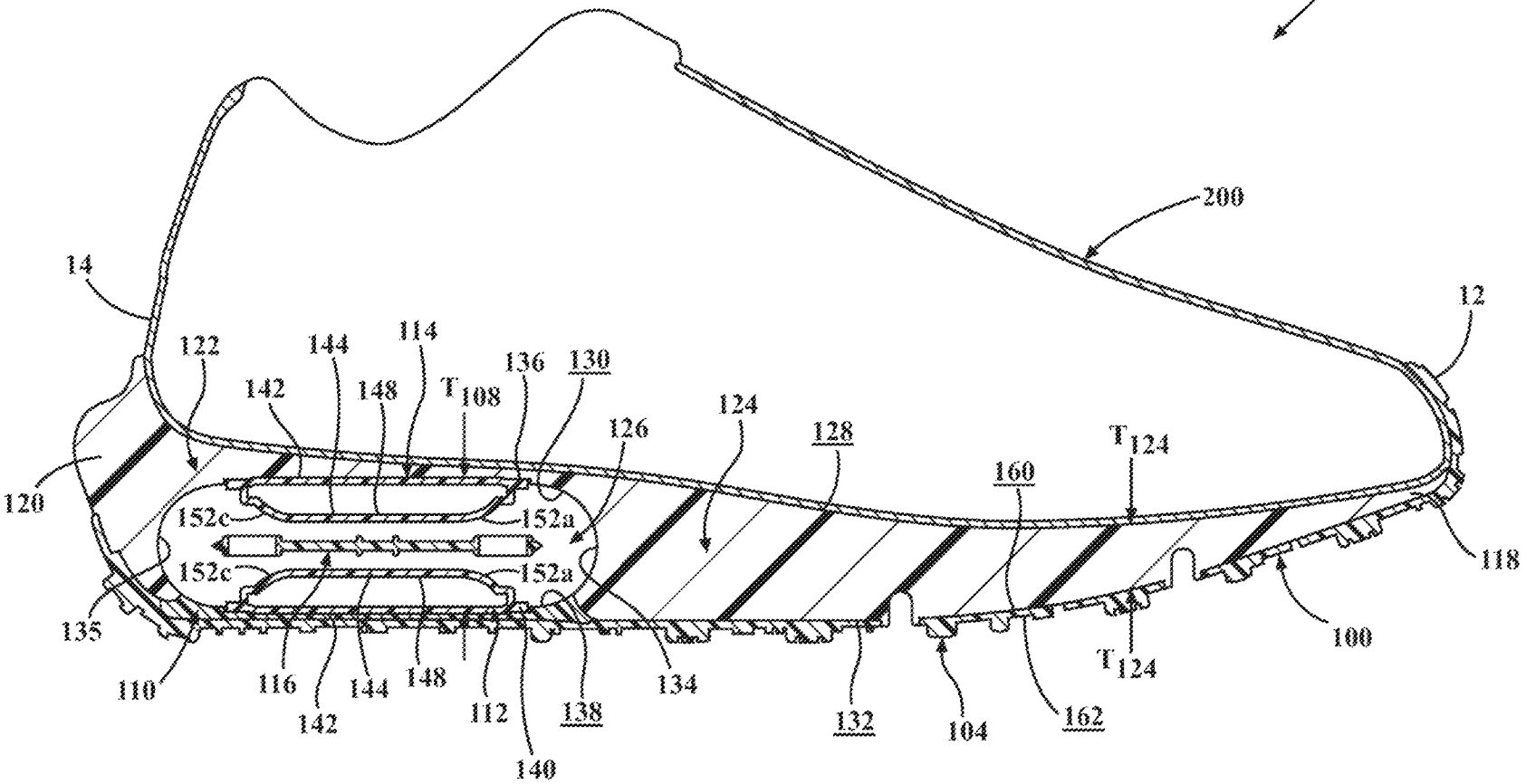
FIG. 4 is a cross-section view of the article of footwear of FIG. 1, taken along Line 4-4 in FIG. 3.

Referring to FIG. 1, an article of footwear 10 includes a sole structure 100 and an upper 200 attached to the sole structure. The footwear 10 may further include an anterior end 12 associated with a forward-most point of the footwear, and a posterior end 14 corresponding to a rearward-most point of the footwear 10. As shown in FIG. 3, a longitudinal axis AF of the footwear 10 extends along a length of the footwear 10 from the anterior end 12 to the posterior end 14 parallel to a ground surface, and generally divides the footwear 10 into a lateral side 16 and a medial side 18. Accordingly, the lateral side 16 and the medial side 18 respectively correspond with opposite sides of the footwear 10 and extend from the anterior end 12 to the posterior end 14. As used herein, a longitudinal direction refers to the direction extending from the anterior end 12 to the posterior end 14, while a lateral direction refers to the direction transverse to the longitudinal direction and extending from the lateral side 16 to the medial side 18.

The article of footwear 10 may be divided into one or more regions. The regions may include a forefoot region 20, a mid-foot region 22, and a heel region 24. The forefoot region 20 corresponds to a ball portion of the foot including the metatarsophalangeal (MTP) joint. The mid-foot region 22 may correspond with an arch area of the foot, and the heel region 24 may correspond with rear portions of the foot, including a calcaneus bone.

Figure 2:
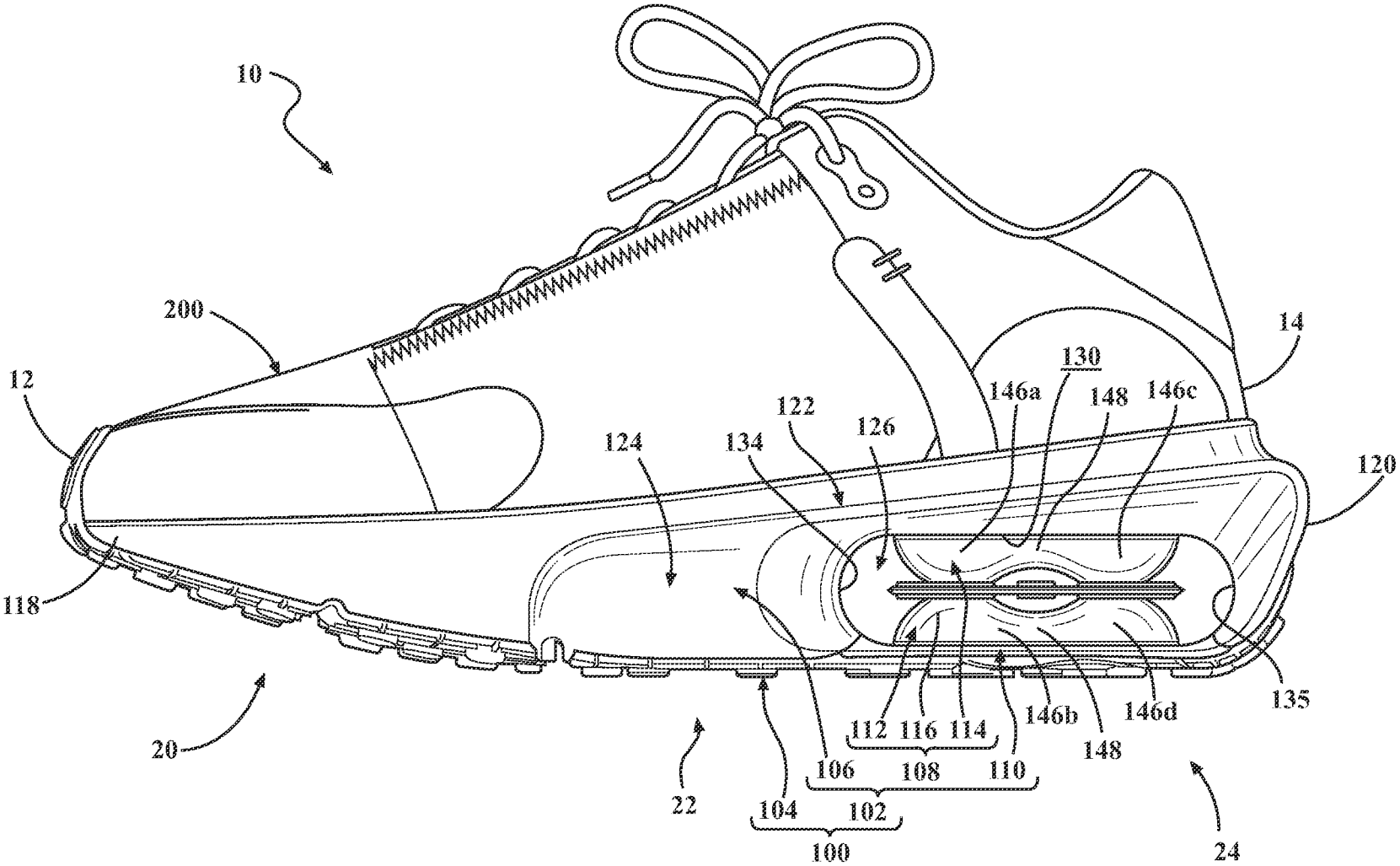
FIG. 2 is a medial side elevation view of the article of footwear of FIG. 1.

With reference to FIGS. 1 and 2, the sole structure 100 includes a midsole 102 configured to provide cushioning characteristics to the sole structure 100, and an outsole 104 configured to provide a ground-engaging surface of the article of footwear 10. Unlike conventional sole structures, the midsole 102 of the sole structure 100 may be formed compositely and include a plurality of subcomponents for providing desired forms of cushioning and support throughout the sole structure 100. For example, the midsole 102 includes a chassis 106 extending from the anterior end 12 to the posterior end 14, and a cushioning arrangement 108 disposed within the heel region 24. Optionally, the midsole 102 may include a cradle 110 configured to receive and support a lower portion of the cushioning arrangement 108 within the chassis 106. The chassis 106 is configured to be attached to the upper 200 and provides an interface between the upper 200 and the cushioning arrangement 108. As described in greater detail below, the cushioning arrangement includes a lower cushioning element 112 and an upper cushioning element 114 arranged in a stacked configuration in the heel region 24. Optionally, the cushioning arrangement 108 includes a support plate 116 interposed between the lower cushioning element 112 and the upper cushioning element 114.

With reference to FIGS. 1 and 2, the chassis 106 of the midsole 102 extends continuously from a first end 118 at the anterior end 12 to a second end 120 at the posterior end 14. An upper portion of the chassis 106 includes a footbed 122 configured to attach to the upper 200 and to provide support and cushioning for a plantar surface of the foot. A lower portion of the chassis 106 includes a forefoot support member 124 formed in the forefoot region 20 and the mid-foot region 22, and a recess 126 extending through the mid-foot region 22 and the heel region 24. As discussed below, the forefoot support member 124 is configured to provide cushioning along the forefoot region 20, while the recess 126 is configured to receive the cushioning arrangement 108 for supporting the heel region 24 of the upper 200.

The footbed 122 extends continuously from the first end 118 to the second end 120 of the chassis 106 and defines a top surface 128 of the chassis 106 configured to face the upper 200 when the article of footwear 10 is assembled. The footbed 122 also includes a lower surface 130 formed on an opposite side from the top surface 128, where a distance between the top surface 128 and the lower surface 130 forms a thickness of the footbed 122. As shown, the forefoot support member 124 depends from the lower surface 130 of the footbed 122 and defines a bottom surface 132 of the chassis 106. Here, the forefoot support member 124 extends continuously from the first end 118 to a first end wall 134 formed in the mid-foot region 22. A thickness $T_{124}$ of the support member 124 progressively increases along a direction from the first end 118 to the end wall 134.

The recess 126 is formed adjacent to the forefoot support member 124 and extends at least partially through the heel region 24 from the first end wall 134 in the mid-foot region 22 to a second end wall 135 in the heel region 24, adjacent to the second end 120. The first end wall 134 faces the second end wall 135 to define a length of the recess 126. As shown, each end wall 134, 135 may have a concave profile extending across a width of the chassis 106 from the lateral side 16 to the medial side 18. In use, the concave geometries of the end walls 134, 135 allow upper and lower portions of the end walls 134, 135 to flex towards each other, which provides a spring-like compression of the end walls 134, 135 during use. A depth or height of the recess 126 is defined by a distance from the bottom surface 132 of the chassis 106 to the lower surface 130 of the footbed 122. The lower surface 130 of the footbed 122 may include an upper socket 136 facing the recess 126. As described in greater detail below, the upper socket 136 is configured to interface with or receive an upper portion of the cushioning arrangement 108 to secure a position of the cushioning arrangement 108 within the recess 126.

As described above, the chassis 106 is formed of a resilient polymeric material, such as foam or rubber, to impart properties of cushioning, responsiveness, and energy distribution to the foot of the wearer. Example resilient polymeric materials for the chassis 106 may include those based on foaming or molding one or more polymers, such as one or more elastomers (e.g., thermoplastic elastomers (TPE)). The one or more polymers may include aliphatic polymers, aromatic polymers, or mixtures of both; and may include homopolymers, copolymers (including terpolymers), or mixtures of both.

In some aspects, the one or more polymers may include olefinic homopolymers, olefinic copolymers, or blends thereof. Examples of olefinic polymers include polyethylene, polypropylene, and combinations thereof. In other aspects, the one or more polymers may include one or more ethylene copolymers, such as, ethylene-vinyl acetate (EVA) copolymers, EVOH copolymers, ethylene-ethyl acrylate copolymers, ethylene-unsaturated mono-fatty acid copolymers, and combinations thereof.

In further aspects, the one or more polymers may include one or more polyacrylates, such as polyacrylic acid, esters of polyacrylic acid, polyacrylonitrile, polyacrylic acetate, polymethyl acrylate, polyethyl acrylate, polybutyl acrylate, polymethyl methacrylate, and polyvinyl acetate; including derivatives thereof, copolymers thereof, and any combinations thereof.

In yet further aspects, the one or more polymers may include one or more ionomeric polymers. In these aspects, the ionomeric polymers may include polymers with carboxylic acid functional groups, sulfonic acid functional groups, salts thereof (e.g., sodium, magnesium, potassium, etc.), and/or anhydrides thereof. For instance, the ionomeric polymer(s) may include one or more fatty acid-modified ionomeric polymers, polystyrene sulfonate, ethylene-methacrylic acid copolymers, and combinations thereof.

In further aspects, the one or more polymers may include one or more styrenic block copolymers, such as acrylonitrile butadiene styrene block copolymers, styrene acrylonitrile block copolymers, styrene ethylene butylene styrene block copolymers, styrene ethylene butadiene styrene block copolymers, styrene ethylene propylene styrene block copolymers, styrene butadiene styrene block copolymers, and combinations thereof.

In further aspects, the one or more polymers may include one or more polyamide copolymers (e.g., polyamide-polyether copolymers) and/or one or more polyurethanes (e.g., cross-linked polyurethanes and/or thermoplastic polyurethanes). Examples of suitable polyurethanes include those discussed below for the barrier layers 142, 144. Alternatively, the one or more polymers may include one or more natural and/or synthetic rubbers, such as butadiene and isoprene.

When the resilient polymeric material is a foamed polymeric material, the foamed material may be foamed using a physical blowing agent which phase transitions to a gas based on a change in temperature and/or pressure, or a chemical blowing agent which forms a gas when heated above its activation temperature. For example, the chemical blowing agent may be an azo compound such as azodicarbonamide, sodium bicarbonate, and/or an isocyanate.

In some embodiments, the foamed polymeric material may be a crosslinked foamed material. In these embodiments, a peroxide-based crosslinking agent such as dicumyl peroxide may be used. Furthermore, the foamed polymeric material may include one or more fillers such as pigments, modified or natural clays, modified or unmodified synthetic clays, talc glass fiber, powdered glass, modified or natural silica, calcium carbonate, mica, paper, wood chips, and the like.

The resilient polymeric material may be formed using a molding process. In one example, when the resilient polymeric material is a molded elastomer, the uncured elastomer (e.g., rubber) may be mixed in a Banbury mixer with an optional filler and a curing package such as a sulfur-based or peroxide-based curing package, calendared, formed into shape, placed in a mold, and vulcanized.

In another example, when the resilient polymeric material is a foamed material, the material may be foamed during a molding process, such as an injection molding process. A thermoplastic polymeric material may be melted in the barrel of an injection molding system and combined with a physical or chemical blowing agent and optionally a cross-linking agent, and then injected into a mold under conditions which activate the blowing agent, forming a molded foam.

Optionally, when the resilient polymeric material is a foamed material, the foamed material may be a compression molded foam. Compression molding may be used to alter the physical properties (e.g., density, stiffness and/or durometer) of a foam, or to alter the physical appearance of the foam (e.g., to fuse two or more pieces of foam, to shape the foam, etc.), or both.

The compression molding process desirably starts by forming one or more foam preforms, such as by injection molding and foaming a polymeric material, by forming foamed particles or beads, by cutting foamed sheet stock, and the like. The compression molded foam may then be made by placing the one or more preforms formed of foamed polymeric material(s) in a compression mold, and applying sufficient pressure to the one or more preforms to compress the one or more preforms in a closed mold. Once the mold is closed, sufficient heat and/or pressure is applied to the one or more preforms in the closed mold for a sufficient duration of time to alter the preform(s) by forming a skin on the outer surface of the compression molded foam, fuse individual foam particles to each other, permanently increase the density of the foam(s), or any combination thereof. Following the heating and/or application of pressure, the mold is opened and the molded foam article is removed from the mold.

When included, the cradle 110 is disposed within the recess 126 of the chassis 106 and extends from the first end wall 134 of the forefoot support member 124 to the second end wall 135 of the chassis 106. The cradle 110 includes an inner surface 138 that faces the recess 126 and is configured to interface with a lower portion of the cushioning arrangement 108. For instance, the inner surface 138 may define a lower socket 140 configured to receive the lower portion of the cushioning arrangement 108. Thus, the lower surface 130 of the footbed 122 and the inner surface 138 of the cradle 110 are arranged on opposite sides of the recess 126 and cooperate to define the height of the recess 126. The cradle 110 includes one or more materials having a greater hardness than the materials of the chassis 106 and the outsole 104. Accordingly, the cradle 110 provides a stiffer stabilizing interface between the cushioning arrangement 108 and the ground surface.

With continued reference to FIGS. 1 and 2, the cushioning arrangement 108 of the midsole 102 includes the lower cushioning element 112 and the upper cushioning element 114 arranged in a stacked configuration within the recess 126. The cushioning arrangement 108 may further include the support plate 116 interposed between the lower cushioning element 112 and the upper cushioning element 114. The cushioning elements 112, 114 include resilient and compressible materials, and are configured to provide cushioning in the heel region 24. Conversely, the support plate 116 may include materials having a greater hardness than the cushioning elements 112, 114 such that the support plate 116 provides a stabilizing interface between the cushioning elements 112, 114.

Figure 7:
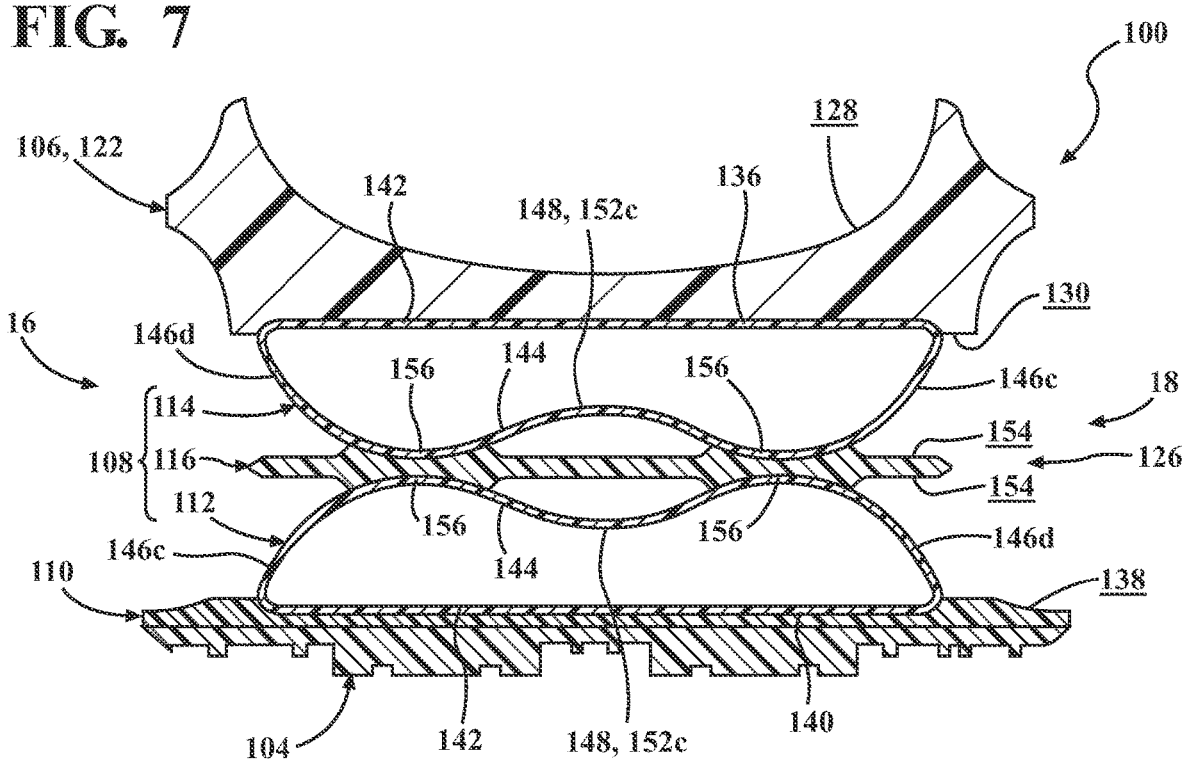
FIG. 7 is a cross-section view of the article of footwear of FIG. 1, taken along Line 7-7 in FIG. 3.
Figure 8:
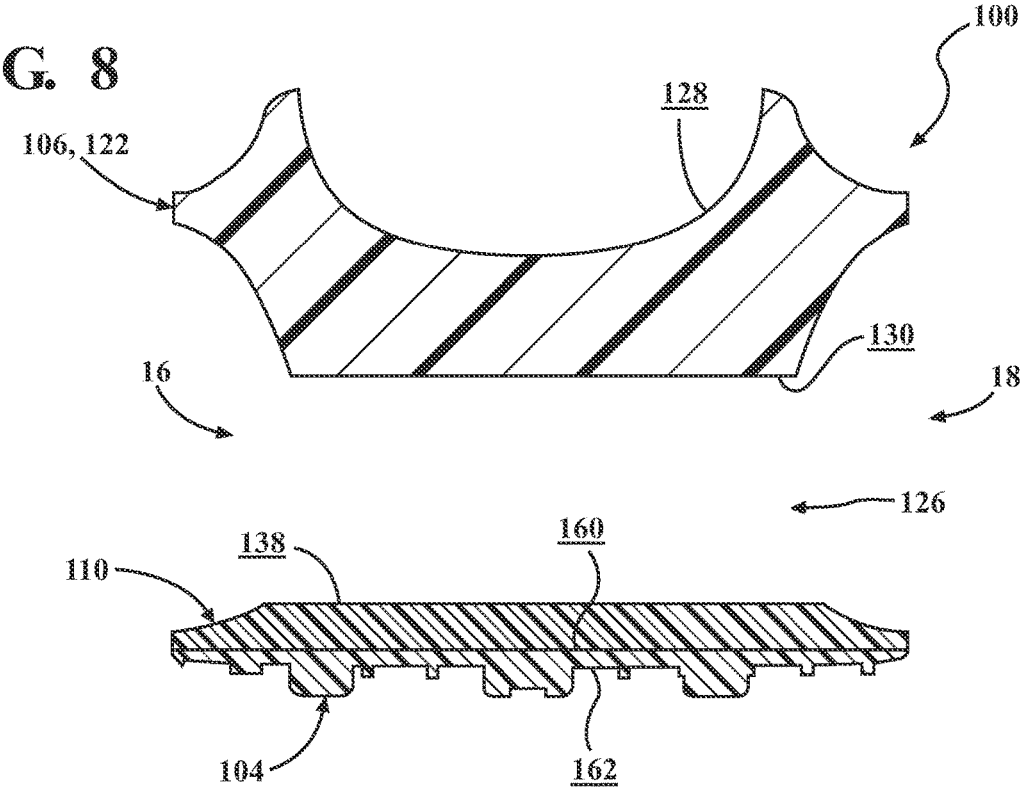
FIG. 8 is a cross-section view of the article of footwear of FIG. 1, taken along Line 8-8 in FIG. 3.
Figure 9:
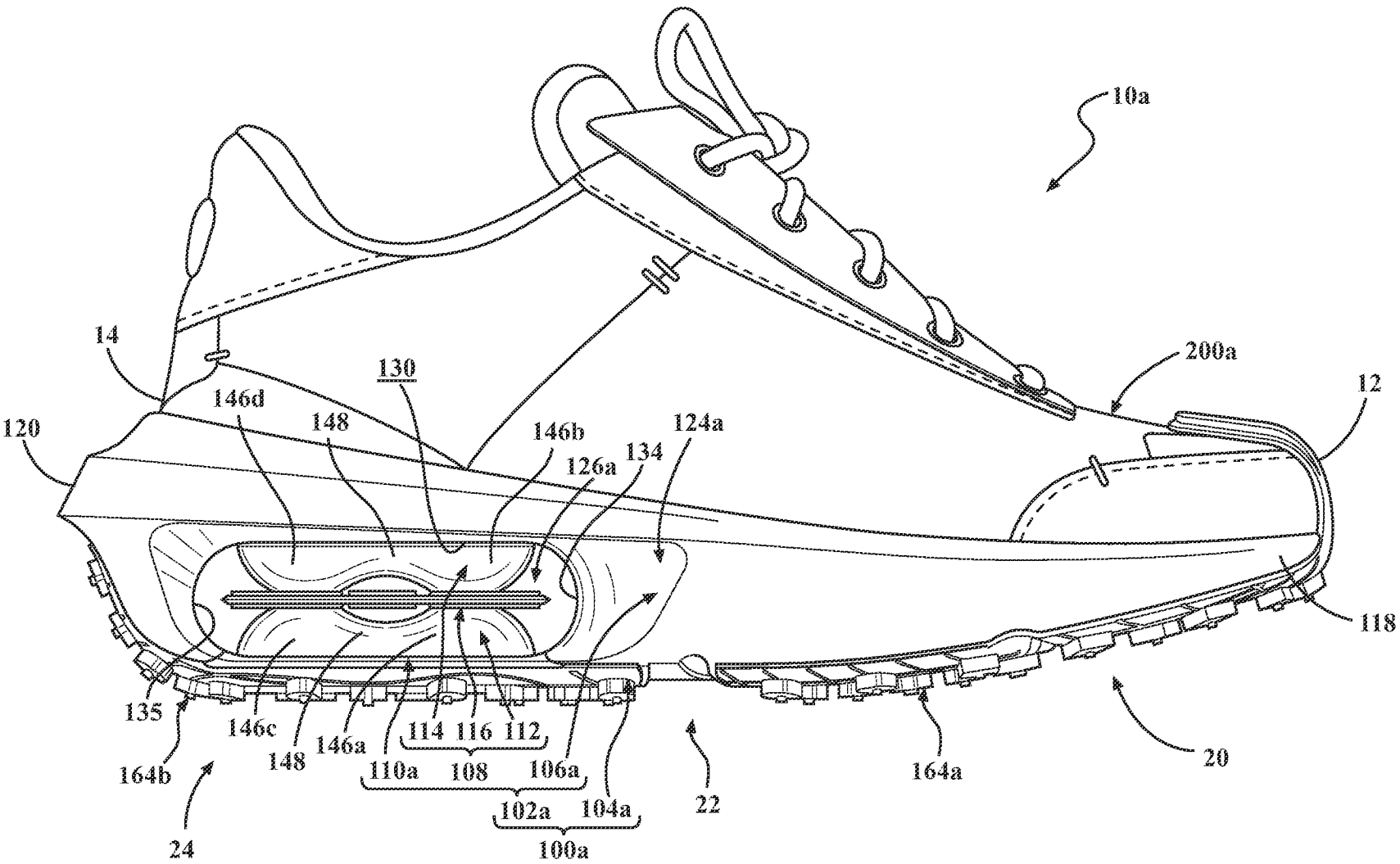
FIG. 9 is a lateral side elevation view of an article of footwear including a sole structure in accordance with the principles of the present disclosure.
Figure 10:
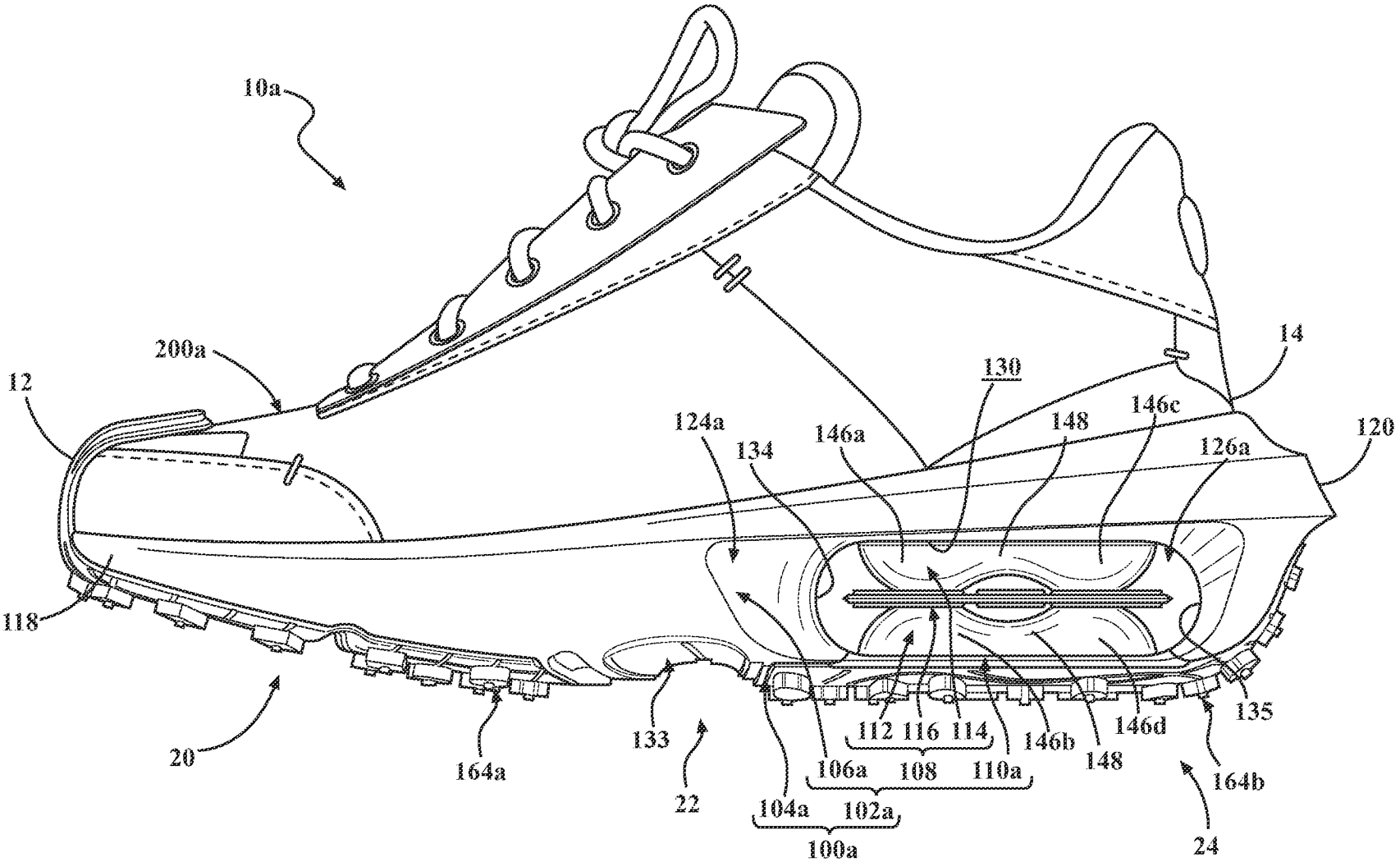
FIG. 10 is a medial side elevation view of the article of footwear of FIG. 9.

In the illustrated example, each of the cushioning elements 112, 114 is formed as a bladder 112, 114 having an interior void filled with a compressible material. In this example, each of the bladders 112, 114 has the same configuration and size, where the lower bladder 112 is attached to the cradle 110 and faces upward while the upper bladder 114 is attached to the lower surface 130 of the footbed 122 and faces downward, as shown in FIGS. 7-8. As shown in the cross-sectional views of FIGS. 1 and 2, each of the bladders 112, 114 may be formed by an opposing pair of barrier layers 142, 144, which can be joined to each other at a peripheral seam to define an overall shape of the bladders 112, 114. As discussed below, the barrier layers 142, 144 include a substantially flat base barrier layer 142 attached to the midsole 102 and a deformable cushioning barrier layer 144 extending into the recess 126.

As used herein, the term "barrier layer" (e.g., barrier layers 142, 144) encompasses both monolayer and multilayer films. In some embodiments, one or both of the barrier layers 142, 144 are each produced (e.g., thermoformed or blow molded) from a monolayer film (a single layer). In other embodiments, one or both of the barrier layers 142, 144 are each produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

One or both of the barrier layers 142, 144 can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

The barrier layers 142, 144 can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4,4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials, as well as with the TPU copolymers described herein and optionally including combinations of polyimides and crystalline polymers, are also suitable.

The barrier layers 142, 144 may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entireties. In embodiments where the barrier layers 142, 144 include two or more sublayers, examples of suitable multilayer films include microlayer films, such as those disclosed in Bonk et al., U.S. Pat. No. 6,582,786, which is incorporated by reference in its entirety. In further embodiments, the barrier layers 142, 144 may each independently include alternating sublayers of one or more TPU copolymer materials and one or more EVOH copolymer materials, where the total number of sublayers in each of the barrier layers 142, 144 includes at least four (4) sublayers, at least ten (10) sublayers, at least twenty (20) sublayers, at least forty (40) sublayers, and/or at least sixty (60) sublayers.

The bladders 112, 114 can be produced from the barrier layers 142, 144 using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 142, 144 can be produced by co-extrusion followed by vacuum thermoforming to form the profile of the cushioning arrangement 108, which can optionally include one or more valves (e.g., one way valves) that allows the cushioning arrangement 108 to be filled with the fluid (e.g., gas).

The barrier layers 142, 144 have a low gas transmission rate to preserve its retained gas pressure. In some embodiments, the barrier layers 142, 144 have a gas transmission rate for nitrogen gas that is at least about ten (10) times lower than a nitrogen gas transmission rate for a butyl rubber layer of substantially the same dimensions. In an aspect, cushioning arrangement 108 has a nitrogen gas transmission rate of 15 cubic-centimeter/square-meter-atmosphere-day ($cm^3/m^2 \cdot atm \cdot day$) or less for an average film thickness of 500 micrometers (based on thicknesses of barrier layers 142, 144). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

As previously mentioned, the bladder 112, 114 may be generally described as including a base barrier layer 142 configured to attach to one of the sockets 136, 140, and a cushioning barrier layer 144 configured to extend into the recess 126. The base barrier layer 142 of each bladder 112, 114 is substantially flat, while the cushioning barrier layer 144 is contoured and substantially defines the geometry of the bladder 112, 114. The barrier layers 142, 144 are joined together along the peripheral seam to define an outer peripheral profile of the bladders 112, 114.

Interior surfaces of the barrier layers 142, 144 are spaced apart from each other to define an interior void filled with a compressible material. The interior voids of the bladders 112, 114 can be provided in a fluid-filled (e.g., as provided in footwear 10) or in an unfilled state. The bladders 112, 114 can be filled to include any suitable fluid, such as a gas or liquid. In an aspect, the gas can include air, nitrogen ($N_2$), or any other suitable gas. The fluid provided to the bladders 112, 114 can result in the bladders 112, 114 being pressurized at a first pressure. In some examples, the first pressure ranges from 0 psi to 20 psi, and more particularly from 5 psi to 15 psi, and even more particularly from 7 psi to 10 psi. The second pressure may range from 0 psi to 35 psi, and more particularly from 15 psi to 30 psi, and even more particularly from 20 psi to 25 psi. Alternatively, the fluid provided to the bladders 112, 114 can be at atmospheric pressure such that the bladders 112, 114 are not pressurized but, rather, simply contain a volume of fluid at atmospheric pressure. In other aspects, the bladders 112, 114 can alternatively include other compressible media, such as pellets, beads, ground recycled material, and the like (e.g., foamed beads and/or rubber beads).

With reference to FIGS. 1-8, each bladder 112, 114 includes a plurality of interconnected hemispherical lobes 146*a*-146*d* and an interior depression 148 all defined by the cushioning barrier layer 144 on a first side of the bladder 112, 114. In the illustrated example, the lobes 146*a*-146*d* include four lobes 146*a*-146*d* arranged in a quad-shaped configuration. In other words, the lobes 146*a*-146*d* may be described as being arranged in a two-by-two configuration, where two of the lobes 146*a*-146*d* are arranged along a first side of the bladder 112, 114 and another two of the lobes 146*a*-146*d* are arranged along an opposite second side of the bladder 112, 114.

Figure 5:
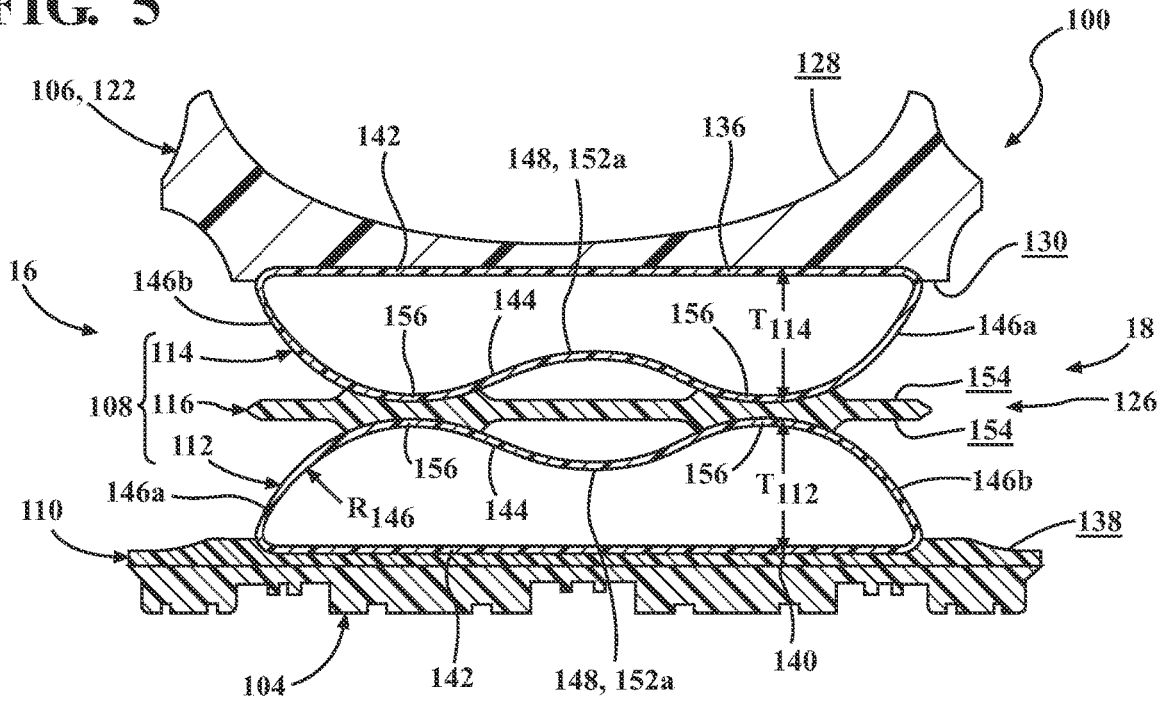
FIG. 5 is a cross-section view of the article of footwear of FIG. 1, taken along Line 5-5 in FIG. 3.

As shown, each of the lobes 146*a*-146*d* has a hemispherical shape defined by the cushioning barrier layer 144 on the first side of the bladder 112, 114. Here, each of the lobes 146*a*-146*d* has the same size and shape, such that a radius $R_{146}$ of each lobe 146*a*-146*d* defines a maximum thickness $T_{112}$, $T_{114}$ of the bladder 112, 114 (FIG. 5). As discussed above, the lobes 146*a*-146*d* are arranged in a quad-shaped pattern such that center points of each of the lobes 146*a*-146*d* are each positioned at a corner of a theoretical square pattern. Thus, center points of adjacent ones of the lobes 146*a*-146*d* are spaced apart from each other by a distance corresponding to a length of each side of the square pattern. As shown, the distances between adjacent ones of the lobes 146*a*-146*d* are less than the twice the radius $R_{146}$ of each of the lobes 146*a*-146*d* such that adjacent ones of the lobes 146*a*-146*d* overlap or intersect with each other.

With continued reference to FIGS. 4-7, the cushioning barrier layer 144 defines the interior depression 148 formed between the lobes 146*a*-146*d*. Generally, the interior depression 148 is formed by a portion of the bladder 112, 114 having a reduced thickness relative to the lobes 146*a*-146*d*. The interior depression 148 may be described as including a central portion 150 (FIG. 6) surrounded by all of the lobes 146*a*-146*d*, and a plurality of valleys or channels 150*a*-150*d* (FIGS. 5-7) extending radially outwardly from the central portion 150. Here, each of the channels 150*a*-150*d* is defined where adjacent ones of the hemispherical lobes 146*a*-146*d* intersect with each other. The channels 150*a*-150*d* may have a concave curvature extending between adjacent ones of the lobes 146*a*-146*d*.

Figure 6:
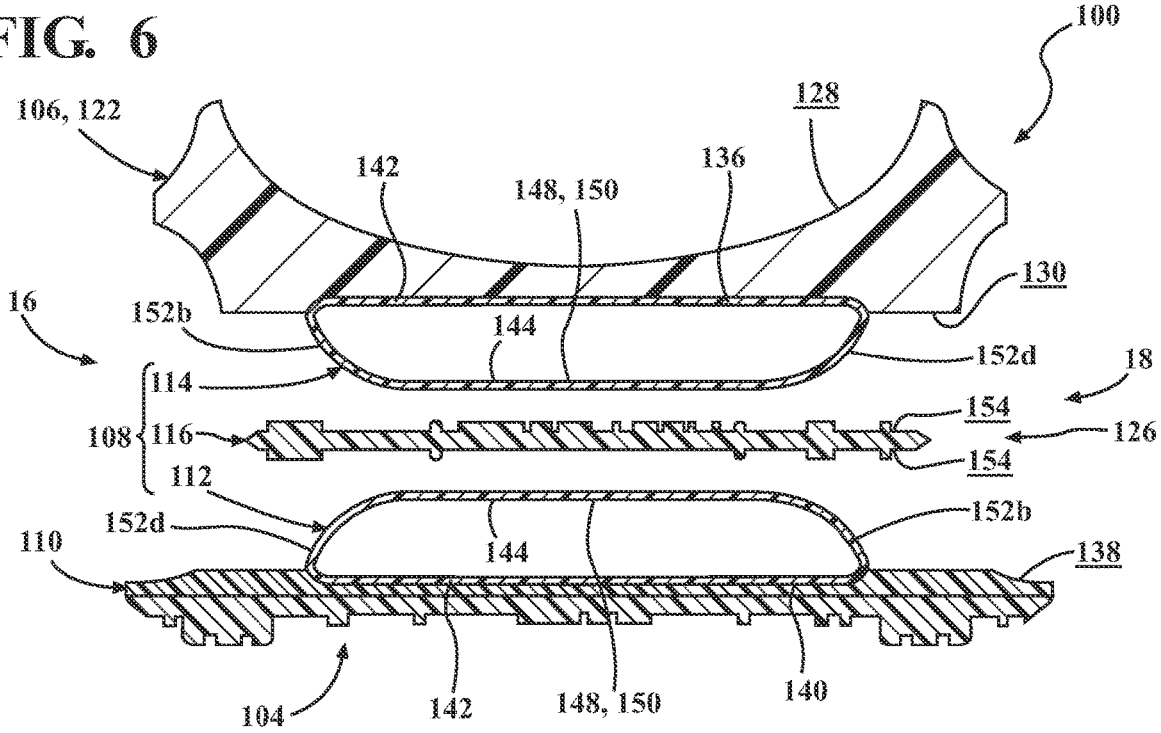
FIG. 6 is a cross-section view of the article of footwear of FIG. 1, taken along Line 6-6 in FIG. 3.

Referring to FIGS. 6-8, the support plate 116 of the present example is a rigid or semi-rigid (i.e., greater hardness than the cushioning elements 112, 114) member configured to provide a stabilizing interface between the upper and lower bladders 112, 114 when the cushioning arrangement 108 is assembled. The support plate 116 includes upper and lower support surfaces 154 formed on opposite sides of the support plate 116. The support surfaces 154 each include a plurality of receptacles 156 configured to receive one of the lobes 146*a*-146*d* of one of the bladders 112, 114. Thus, a first one of the support surfaces 154 includes four of the receptacles 156 for receiving the lobes 146*a*-146*d* of the lower bladder 112 and the opposite support surface 154 includes four of the receptacles 156 for receiving the lobes 146*a*-146*d* of the upper bladder 114. In the illustrated example, each of the receptacles 156 is a concave recess formed in or on the support surface 154 of the support plate 116, which receives a distal end of one of the lobes 146*a*-146*d*.

With reference to FIGS. 1, 2 and 4-7, when the cushioning arrangement 108 is assembled, the lobes 146*a*-146*d* of the upper bladder 114 are arranged directly across the support plate 116 from the lobes 146*a*-146*d* of the lower bladder 112. Thus, the lobes 146*a*-146*d* of the upper and lower bladders 112, 114 are aligned with each other across the support plate 116 such that an overall thickness $T_{108}$ of the cushioning arrangement 108 is defined by combined thicknesses of the lobes 146*a*-146*d* of the lower bladder 112, the support plate 116, and the lobes 146*a*-146*d* of the upper bladder 114. Here, the lobes 146*a*-146*d* of the lower bladder 112 may be described as indirectly contacting the lobes 146*a*-146*d* via the support plate 116.

With reference to FIGS. 1-8, when the sole structure 100 is assembled, the cushioning arrangement 108 is received within the recess 126 between the footbed 122 of the chassis 106 and the cradle 110. Particularly, a first end of the cushioning arrangement 108, defined by the base barrier layer 142 of the upper cushioning element 114 is received within the upper socket 136 formed in the lower surface 130 of the footbed 122. A second end of the cushioning arrangement 108, which is formed at an opposite end of the cushioning arrangement 108 from the first end and defined by the base barrier layer 142 of the lower cushioning element 112, is received within the lower socket 140 formed on the inner surface 138 of the cradle 110. Accordingly, opposite ends of the cushioning arrangement 108 are embedded or captured within the upper and lower sockets 136, 140 to secure a position of the cushioning arrangement 108 within the recess 126.

By arranging the lower and upper bladders 112, 114 in the foregoing manner, the thickest portions of the bladders 112, 114 (i.e., the lobes 146*a*-146*d*) cooperate with each other to provide cushioning in the heel region of the sole structure 100, while the interior depressions 148 of the bladders 112, 114 are recessed from each other and the support plate 116 by a space or gap. Thus, when the cushioning arrangement 108 is compressed between the footbed 122 and the cradle 110, the pressure within the lobes 146*a*-146*d* may increase such that the compressible material (e.g., air) disposed within the lobes 146*a*-146*d* is displaced to the lower pressure area of the interior depression 148 of the bladder 112, 114. As the compressible material flows from the lobes 146*a*-146*d* to the interior depression 148, the pressure within the interior depression 148 increases, causing expansion of the cushioning barrier layer 144 along the interior depression 148. Thus, the interior depression 148 serves as an accumulator for the fluid of the bladder 112, 114 when the lobes 146*a*-146*d* are compressed, which allows for a greater degree of compression.

During compression, the support plate 116 provides a rigid interface between the lobes 146*a*-146*d* of the respective bladders 112, 114. In addition to securing a position of each of the lobes 146*a*-146*d*, the support plate 116 may act as a damper to distribute compressive forces among the lobes 146*a*-146*d* of the bladders 112, 114. For instance, when a compressive force is applied directly to one corner of the cushioning arrangement 108, rather than have the entire compressive force be applied through a single opposing pair of the lobes 146*a*-146*d* of the lower and upper bladders 112, 114, the support plate 116 may transfer at least a portion of the compressive force to adjacent ones of the lobes 146*a*-146*d*.

The outsole 104 of the sole structure 100 extends continuously from the anterior end 12 to the posterior end 14 of the sole structure 100 and defines a ground-contacting surface of the footwear 10. The outsole 104 includes an inner surface 160 attached to the bottom of the midsole 102 and an outer surface 162 formed on an opposite side from the inner surface 160 and defining the ground-contacting surface of the footwear. Optionally, the outsole 104 may be formed as a fragmentary structure including a first portion attached to the midsole 102 in a first region 20, 22, 24 and a second portion attached to the midsole 102 in a second region 20, 22, 24.

The upper 200 is attached to the sole structure 100 and includes interior surfaces that define an interior void configured to receive and secure a foot for support on sole structure 100. The upper 200 may be formed from one or more materials that are stitched or adhesively bonded together to form the interior void. Suitable materials of the upper may include, but are not limited to, mesh, textiles, foam, leather, and synthetic leather. The materials may be selected and located to impart properties of durability, air-permeability, wear-resistance, flexibility, and comfort.

With particular reference to FIGS. 9-13, an article of footwear 10*a* is provided and includes a sole structure 100*a* and an upper 200*a* attached to the sole structure 100*a*. In view of the substantial similarity in structure and function of the components associated with the article of footwear 10 with respect to the article of footwear 10*a*, like reference numerals are used hereinafter and in the drawings to identify like components while like reference numerals containing letter extensions are used to identify those components that have been modified.

In the example of the article of footwear 10*a* shown in FIGS. 9-13, the midsole 102*a* has a substantially similar configuration as the midsole 102 discussed above. Particularly, the midsole 102*a* includes a chassis 106*a* including the footbed 122, a forefoot support member 124*a*, and a recess 126*a* formed in the heel region 24. The midsole 102 also includes the cushioning arrangement 108 and a cradle 110*a*.

Figure 11:
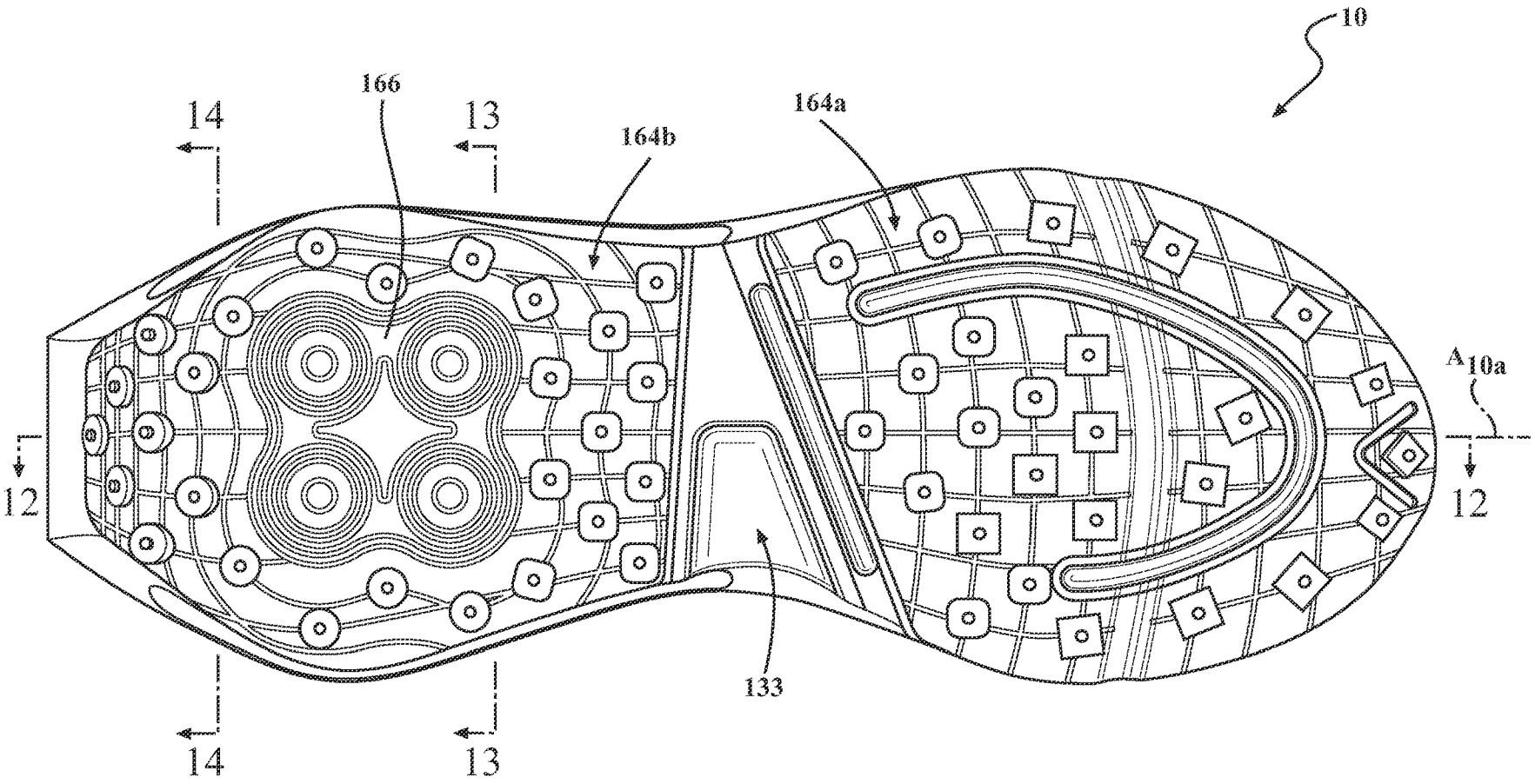
FIG. 11 is a bottom plan view of the article of footwear of FIG. 9.
Figure 12:
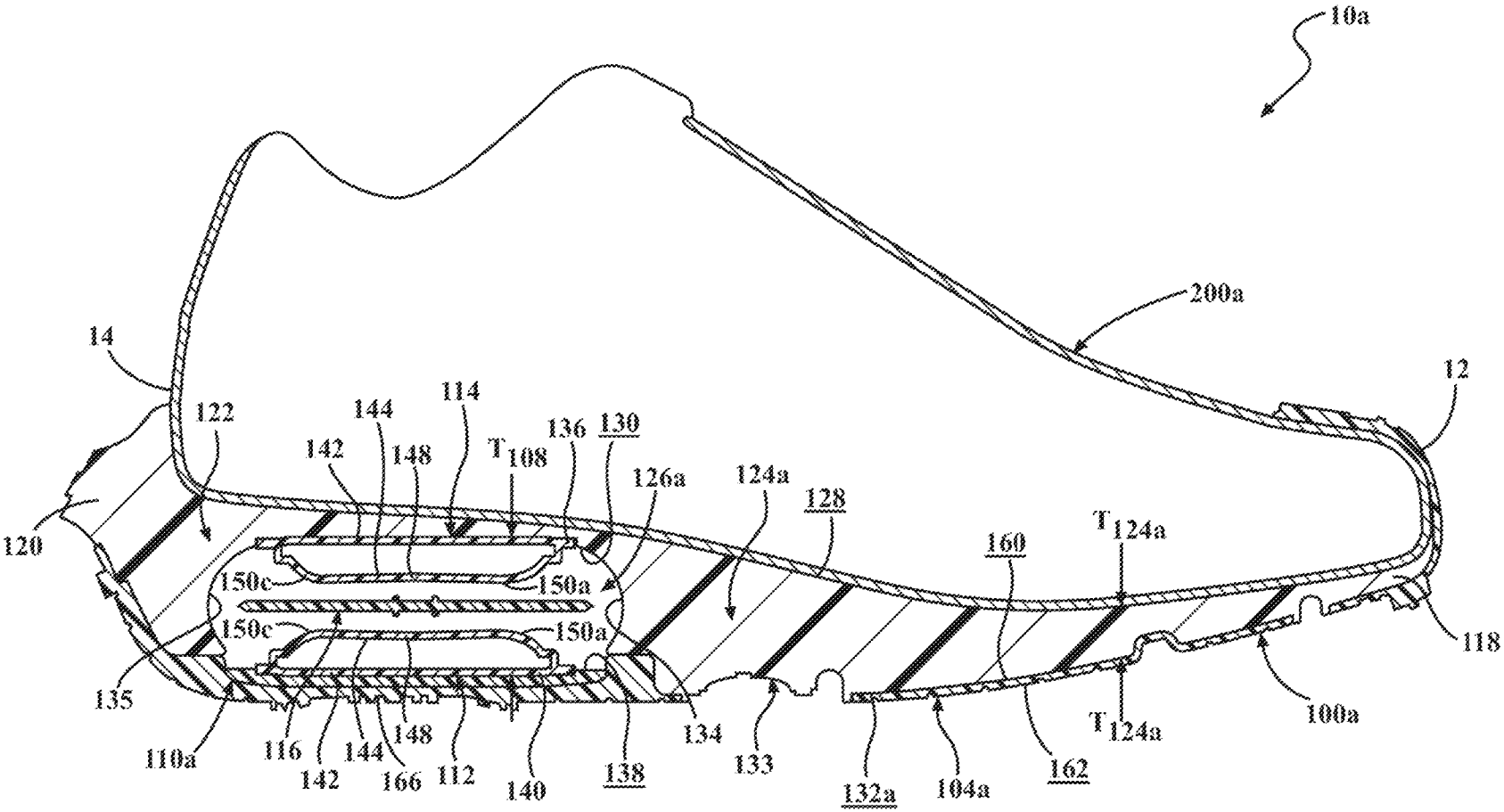
FIG. 12 is a cross-section view of the article of footwear of FIG. 9, taken along Line 12-12 in FIG. 11.
Figure 13:
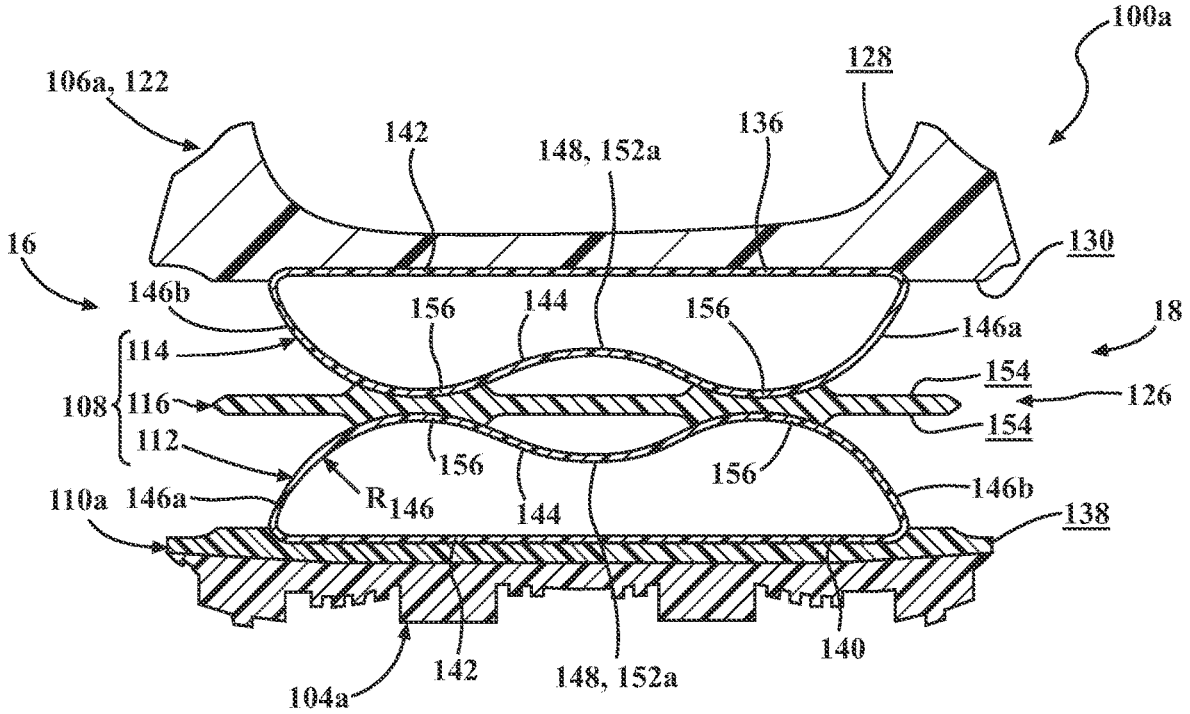
FIG. 13 is a cross-section view of the article of footwear of FIG. 9, taken along Line 13-13 in FIG. 11.
Figure 14:
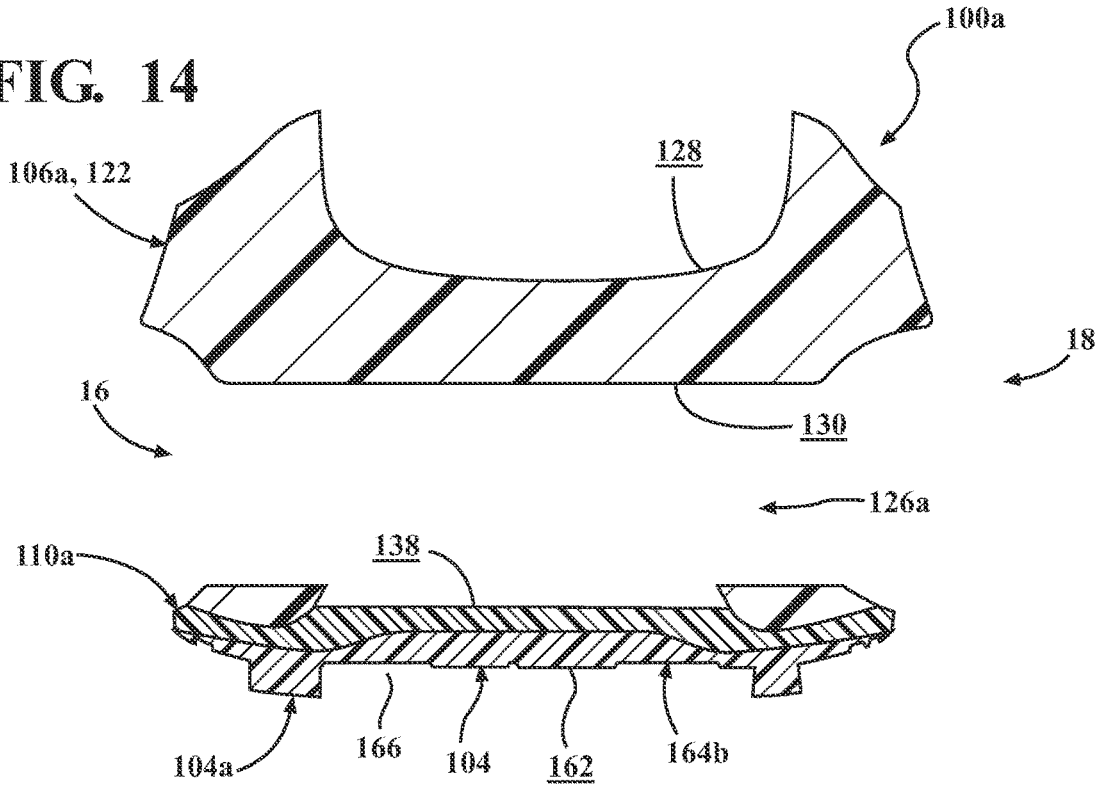
FIG. 14 is a cross-section view of the article of footwear of FIG. 9, taken along Line 14-14 in FIG. 11.

As shown in FIGS. 11 and 12, the midsole 102*a* of the present example includes a bottom surface 132*a* having a laterally extending arch or recess 133 in the mid-foot region 22. The outsole 104*a* of the sole structure 100*a* includes a first fragment 164*a* attached to the bottom surface 132*a* on first side of the recess 133 and a second segment 164*b* attached to the bottom surface on a second side of the recess 133. Thus, the portion of the bottom surface 132*a* including the recess 133 is exposed between the first and second fragments 164*a*, 164*b* of the outsole 104.

As shown in FIGS. 11-14, the second fragment 164*b* of the outsole 104 may include a depression 166 formed in the outer surface 162. The depression 166 is aligned with the cushioning arrangement 108 and may include a peripheral profile corresponding in shape to the peripheral profile of the cushioning arrangement 108. The depression 166 provides the heel portion of the outsole 104*a* with a trampoline-like structure between the cushioning arrangement 108 and the ground surface, which provides an added degree of cushioning and resiliency in the heel region 24.

Figure 15A:
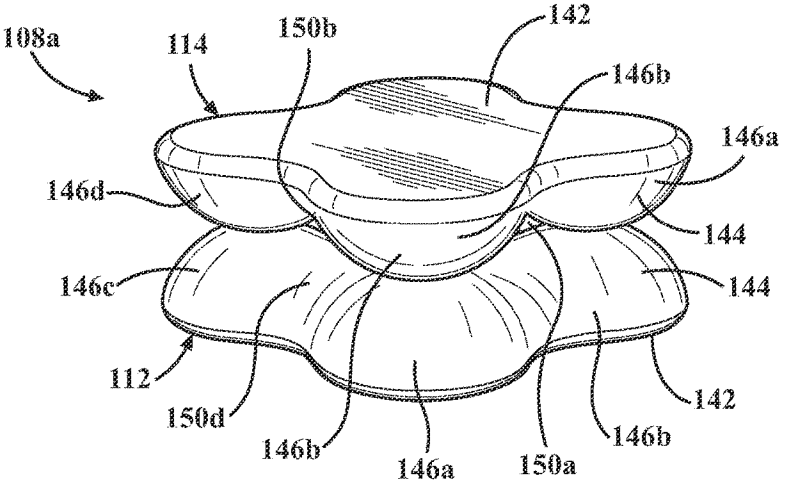
FIGS. 15A and 15B are perspective views of an example of an alternative cushioning arrangement for the article of footwear of FIG. 9.
Figure 15B:
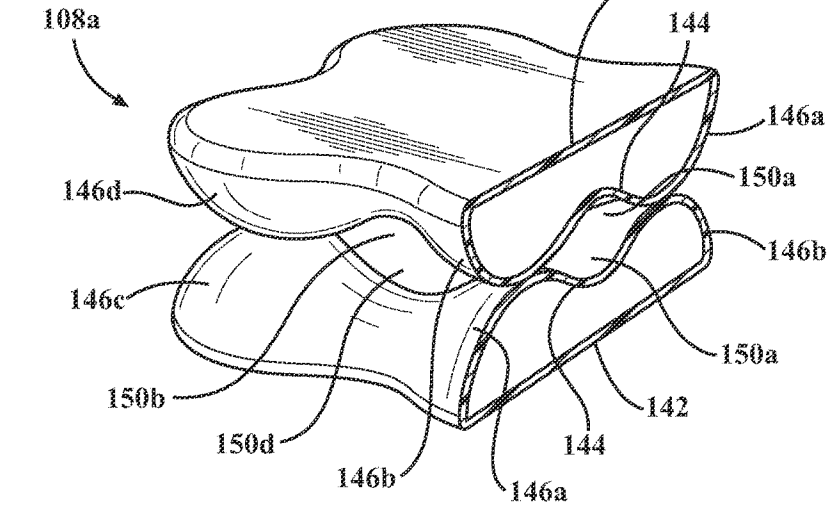

With particular reference to FIGS. 15A and 15B, a cushioning arrangement 108*a* is provided and includes the upper cushioning element 114 and the lower cushioning element 112. In view of the substantial similarity in structure and function of the components associated with the cushioning arrangement 108 with respect to the cushioning arrangement 108*a*, like reference numerals are used hereinafter and in the drawings to identify like components while like reference numerals containing letter extensions are used to identify those components that have been modified.

In the example of the cushioning arrangement 108*a* shown in FIGS. 15A and 15B, the upper and lower cushioning elements 112, 114 are again provided as upper and lower bladders 112, 114 with distal ends of the lobes 146*a*-146*b* of the upper bladder 114 aligned with distal ends of the lobes 146*a*-146*d* of the lower bladder 112. In this example, the support plate 116 is omitted such that distal ends of the lobes 146*a*-146*d* of the bladders 112, 114 are in direct contact with each other. Here, the distal ends of the lobes 146*a*-146*d* of the lower and upper bladders 112, 114 are convex such that the lobes 146*a*-146*d* of the upper bladder 114 and the lobes 146*a*-146*d* of the lower bladder 112 are attached or bonded to each other in a point-contact relationship.

In contrast to the example of the cushioning arrangement 108 described previously, where the lobes 146*a*-146*d* are received within concave receptacles 156 of the support plate 116 to distribute compressive forces, the direct, point-contact relationship between the lobes 146*a*-146*d* of the bladders 112, 114 in the current example provides localized compression. For instance, a compressive force applied at one of the lobes 146*a*-146*d* of the upper bladder 114 is transferred directly to the corresponding lobe 146*a*-146*d* of the lower bladder 112 through the respective distal ends. As the respective lobes 146*a*-146*d* are deformed under the compressive force, the interface between the lobes 146*a*-146*d* transitions from a point-contact to an area-contact. Meanwhile, the compressible material (e.g., air) within the compressed lobes 146*a*-146*d* is displaced to the interior depression 148 and the other lobes 146*a*-146*d* until pressures within the interior voids of the bladders 112, 114 reaches equilibrium.

Figure 16A:
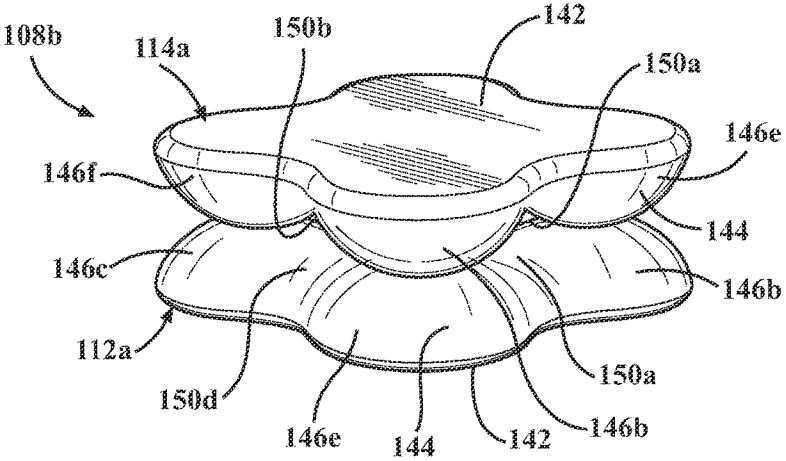
FIGS. 16A and 16B are perspective views of another example of an alternative cushioning arrangement for the article of footwear of FIG. 9.
Figure 16B:
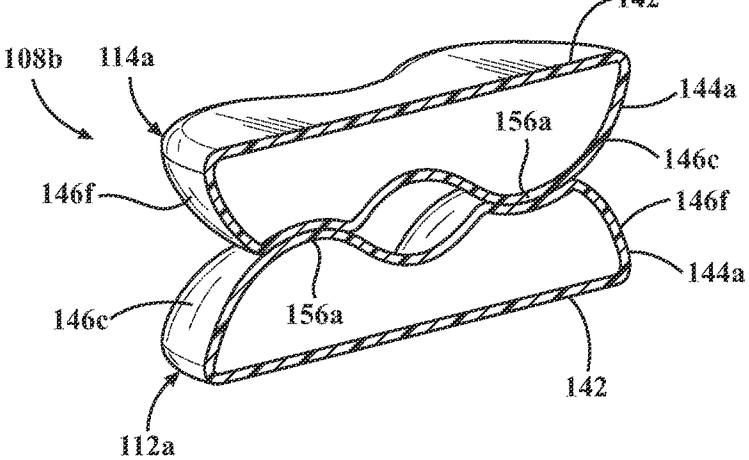

With particular reference to FIGS. 16A and 16B, a cushioning arrangement 108*b* is provided and includes a lower cushioning element 112*a* and an upper cushioning element 114*a*. In view of the substantial similarity in structure and function of the components associated with the cushioning arrangement 108 with respect to the cushioning arrangement 108*b*, like reference numerals are used hereinafter and in the drawings to identify like components while like reference numerals containing letter extensions are used to identify those components that have been modified.

In the example of the cushioning arrangement 108*b* shown in FIGS. 16A and 16B, an upper cushioning element 114*a* is provided in direct contact with the lower cushioning element 112*a*, similar to the arrangement discussed above with respect to the cushioning arrangement 108*a* of FIGS. 15A and 15B. However, in the illustrated example, the cushioning barrier layers 144*a* of the cushioning elements

112*a*, 114*a* define a first pair of the hemispherical lobes 146*b*, 146*c* discussed above at opposite corners of the cushioning element 112*a*, 114*a* and a pair of truncated lobes 146*e*, 146*f* at the other two corners of the cushioning element 112*a*, 114*a*.

As shown, the truncated lobes 146*e*, 146*f* include receptacles 156 configured to mate with the distal ends of the hemispherical lobes 146*b*, 146*c* of the opposing bladder 112*a*, 114*a* when the bladders 112*a*, 114*a* are assembled. Here, the receptacles 156*a* are similar to the receptacles 156 formed in the support plate 116 discussed above. For instance, the receptacles 156*a* have a concave shape corresponding to the convex shape of the distal ends of the lobes 146*b*, 146*c*. Thus, when the cushioning arrangement 108*b* is assembled, the truncated lobes 146*e*, 146*f* of each of the cushioning elements 112*a*, 114*a* are aligned and received within the receptacles 156*a* of the lobes 146*e*, 146*f* of the other cushioning element 112*a*, 114*a* in a ball-and-socket configuration.

With particular reference to FIGS. 17-25, an article of footwear 10*b* is provided and includes a sole structure 100*b* and the upper 200 attached to the sole structure 100*b*. In view of the substantial similarity in structure and function of the components associated with the article of footwear 10 with respect to the article of footwear 10*b*, like reference numerals are used hereinafter and in the drawings to identify like components while like reference numerals containing letter extensions are used to identify those components that have been modified.

Figure 17:
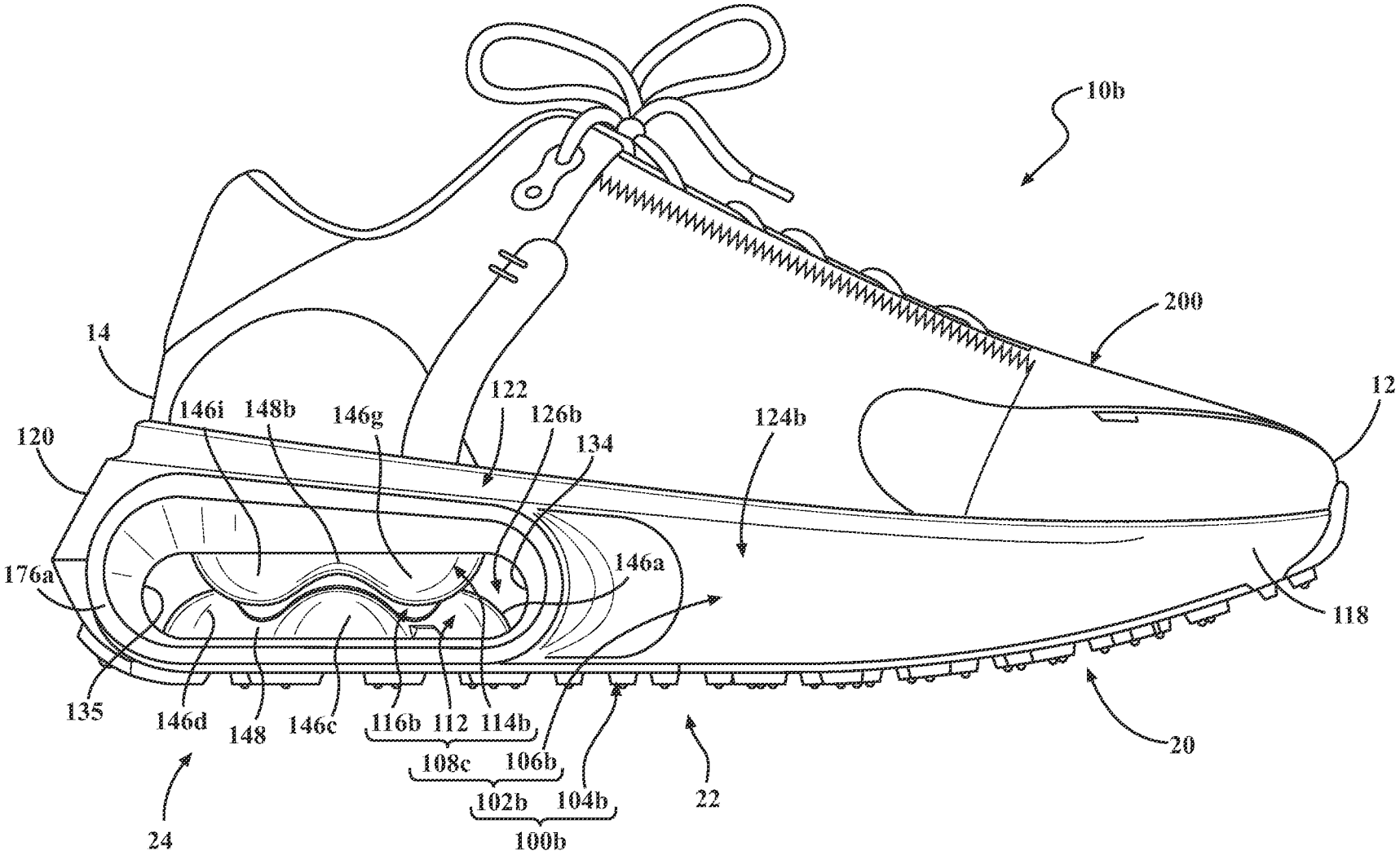
FIG. 17 is a lateral side elevation view of an article of footwear including a sole structure in accordance with the principles of the present disclosure.
Figure 18:
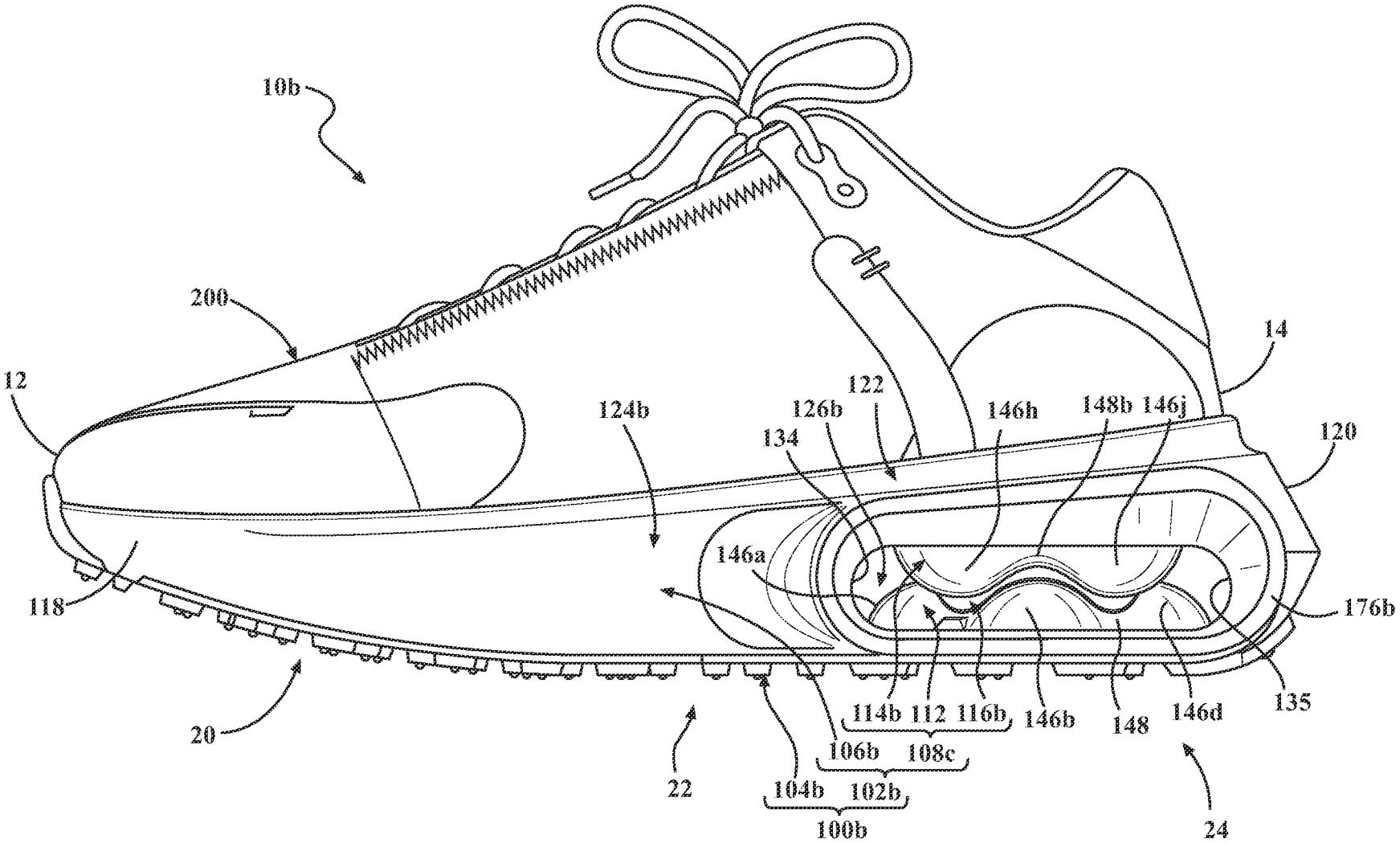
FIG. 18 is a medial side elevation view of the article of footwear of FIG. 17.
Figure 19:
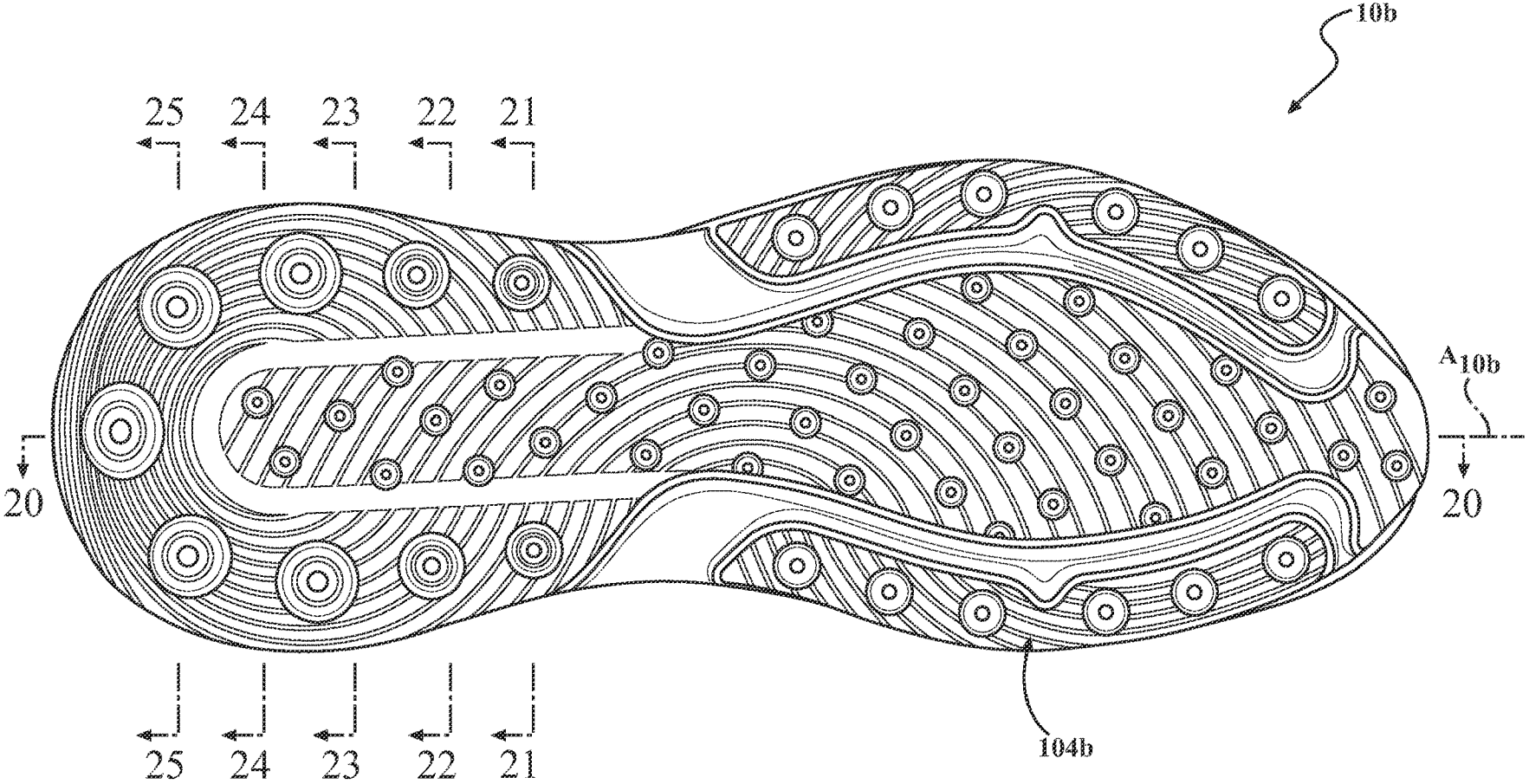
FIG. 19 is a bottom plan view of the article of footwear of FIG. 17.
Figure 20:
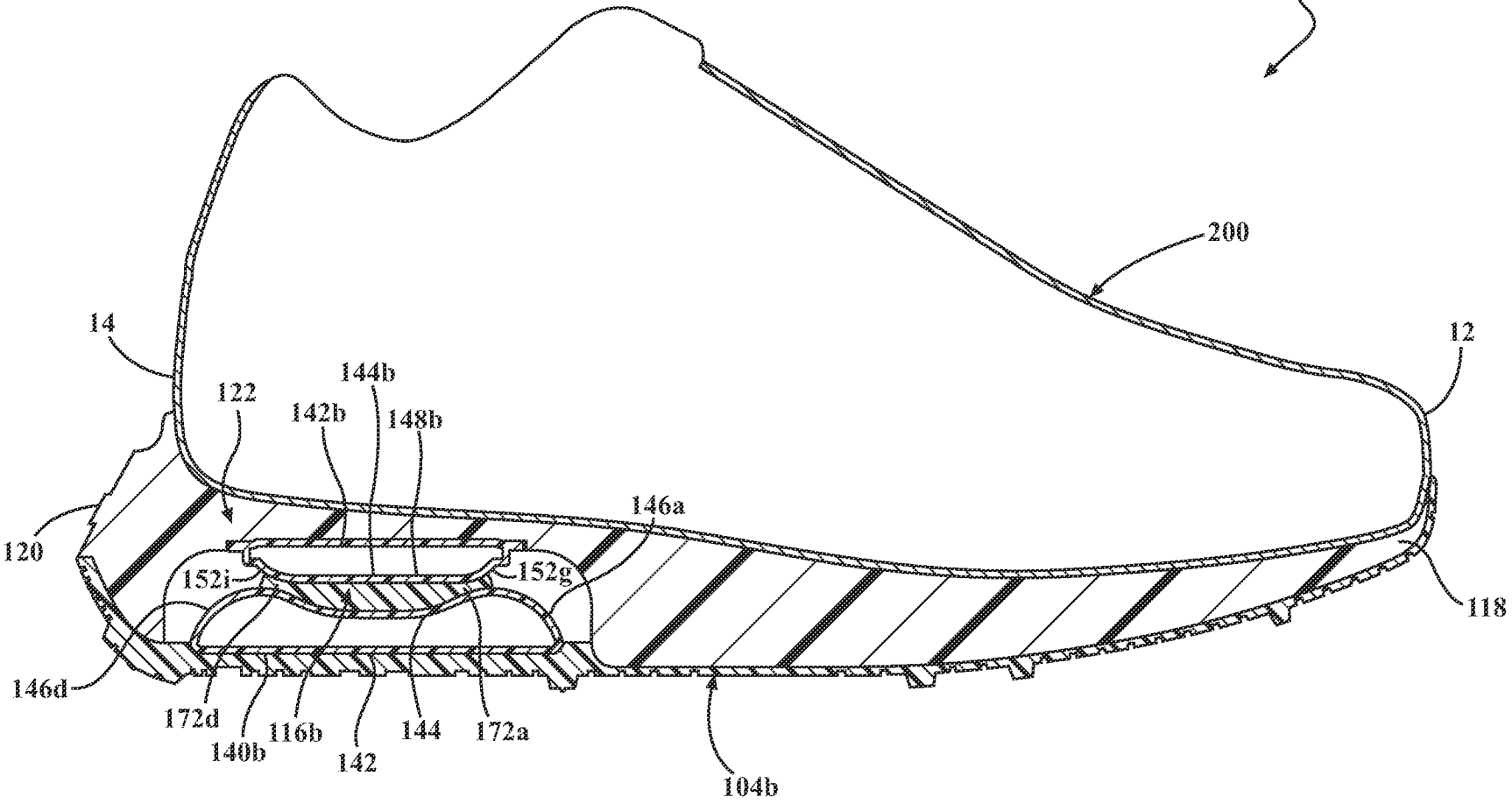
FIG. 20 is a cross-section view of the article of footwear of FIG. 17, taken along Line 20-20 in FIG. 19.

As shown in FIGS. 17 and 18, the article of footwear 10*b* includes a sole structure 100*b* having a midsole 102*b* and an outsole 104*b*. The midsole 102*b* includes a chassis 106*b* having the footbed 122 formed in an upper portion and a forefoot support member 124*b* and recess 126*b* formed on a bottom portion. The midsole 102*b* further includes a cushioning arrangement 108*c* received within the recess 126*b* of the chassis 106*b*, between the footbed 122 and the outsole 104*b*.

With reference to FIGS. 20-25, cross-sections of the sole structure 100*b* are provided to illustrate the construction of the cushioning arrangement 108*c*. Here, the cushioning arrangement 108*c* includes the lower cushioning element 112 and an upper cushioning element 114*b* with a support plate 116*b* interposed between the cushioning elements 112, 114*b*.

In this example, the upper cushioning element 114*b* has a substantially similar configuration to the upper cushioning element 114 discussed above. Accordingly, the upper cushioning element 114*b* is configured as a bladder 114*b* having a base barrier layer 142*b* and a cushioning barrier layer 144*b* defining a plurality of lobes 146*g*-146*j* and an interior depression 148*b*. The interior depression 148*b* includes a central portion 150*b* and a plurality of channels 152*g*-152*j* extending radially outwardly from the central portion 150*b*. Thus, the channels 152*g*-152*j* of the interior depression 148*b* extend between adjacent ones of the lobes 148*g*-148*j*. While the upper bladder 114*b* has a substantially similar geometry as the lower bladder 112, the upper bladder 114*b* has different dimensions than the lower bladder 112. Particularly, the lobes 148*g*-148*j* have a radius $R_{146g}$ that is smaller than the radius $R_{146a}$ of the lobes 146*a*-146*d* of the lower bladder 112. Additionally or alternatively, adjacent ones of the lobes 146*g*-146*j* of the upper bladder 114*b* may be spaced apart by a distance that is less than the distance between adjacent ones of the lobes 146*a*-146*d* of the lower bladder 112.

The support plate 116*b* of the cushioning arrangement 108*c* includes a pair of support surface 154*a*, 154*b* formed on opposite sides of the support plate 116*b*. Unlike the support plate 116 described above, which is substantially flat and includes the receptacles 156, the support plate 116*b* of the current example is contoured such that the upper support surface 154*a* mates with the cushioning barrier layer 144*b* of the upper bladder 114*b* and the lower support surface 154*b* mates with the cushioning barrier layer 144 of the lower bladder 112. Thus, the support plate 116*b* may include a central hub 168 configured to interface with the central portions 150, 150*b* of the bladders 112, 114*b* and an undulated peripheral rim 170 configured to mate with the lobes 146*a*-146*d*, 146*g*-146*j* and channels 152*a*-152*d*, 152*g*-152*j*.

Figure 21:
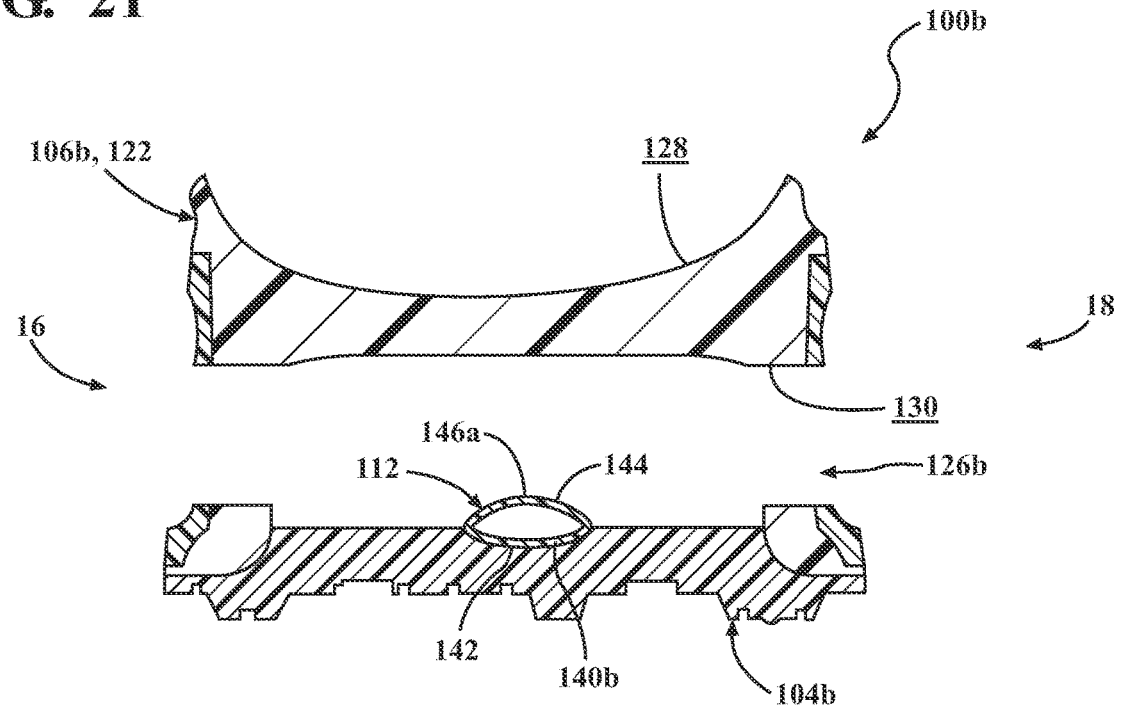
FIG. 21 is a cross-section view of the article of footwear of FIG. 17, taken along Line 21-21 in FIG. 19.
Figure 22:
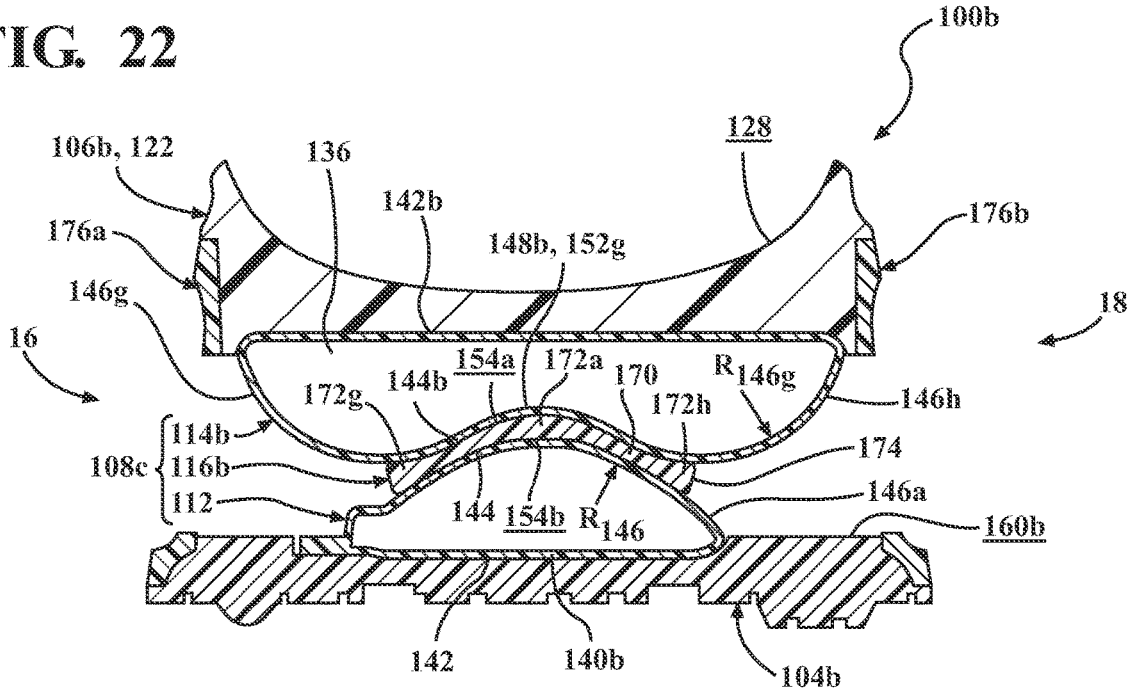
FIG. 22 is a cross-section view of the article of footwear of FIG. 17, taken along Line 22-22 in FIG. 19.

Referring to FIGS. 17, 18, and 22-23, the cushioning arrangement 108*c* includes the upper bladder 114*b* and the lower bladder 112 arranged in a stacked configuration with the support plate 116*b* interposed therebetween. As in the previous examples, the upper bladder 114*b* and the lower bladder 112 are arranged such that the cushioning barrier layers 144, 144*b* face each other. However, in the current example, the lower bladder 112 is rotated relative to the longitudinal axis $A_{10}$ and the upper bladder 114*b* such that the lobes 146*a*-146*d* of the lower bladder 112 are offset (i.e., not vertically aligned) from the lobes 146*g*-146*j* of the upper bladder 114*b*. As shown in FIGS. 21 and 22, the lobes 146*a*-146*d* of the lower bladder 112 are received within the channels 152*g*-152*j* of the upper bladder 114*b*. Likewise, the lobes 146*g*-146*j* of the upper bladder 114*b* are received within the channels 152*a*-152*d* of the lower bladder 112.

Figure 23:
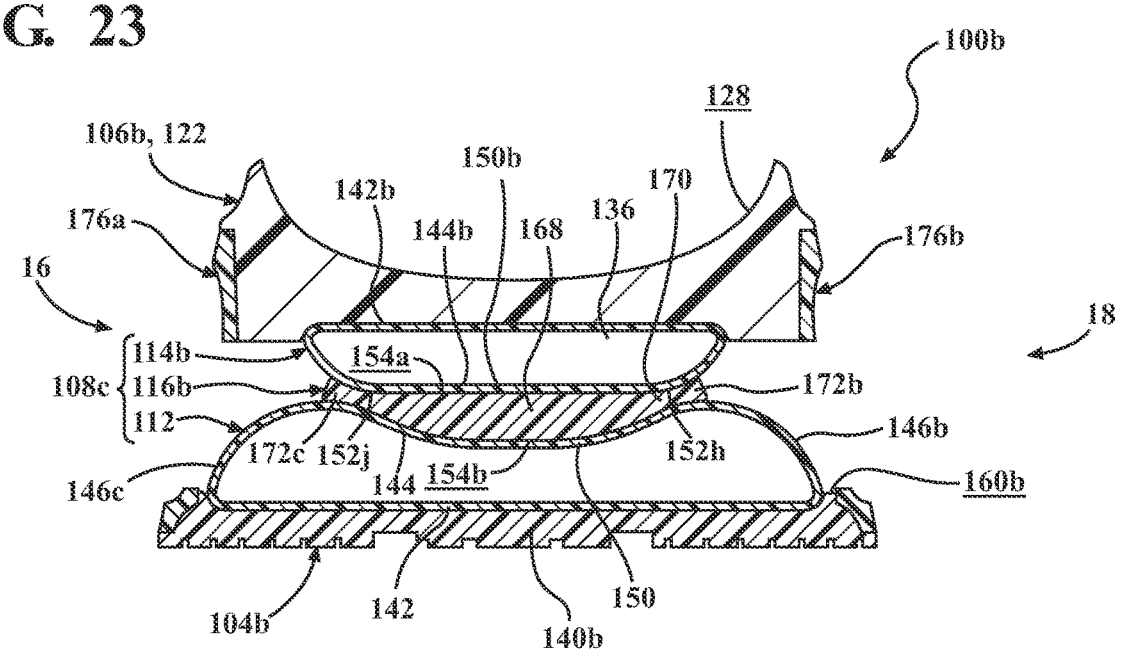
FIG. 23 is a cross-section view of the article of footwear of FIG. 17, taken along Line 23-23 in FIG. 19.

As provided above, the central hub 168 of the support plate 116*b* is received within the central portions 150, 150*b* of the bladders 112, 114*b*. As shown in FIG. 23, the central hub 168 is disposed between the opposing (i.e., facing) portions of the cushioning barrier layers 144, 144*b* forming the central portions 150, 150*b* of the bladders 112, 114*b*. Thus, the central hub 168 fills a space between the central portions 150, 150*b* of the bladders 112, 114*b*.

As shown in FIGS. 17, 18, 22, and 24 the undulated peripheral rim 170 of the support plate 116*b* is interposed between the lobes 146*a*-146*d*, 146*g*-146*j* and channels 152*a*-152*d*, 152*g*-152*j* of the respective bladders 112, 114*b*. The peripheral rim 170 may be described as including first undulations 172*a*-172*d* and second undulations 172*g*-172*j* alternatingly arranged around the central hub 168. The first undulations 172*a*-172*d* are configured to receive corresponding lobes 146*a*-146*d* of the lower bladder 112 and to be received within the channels 152*g*-152*j* of the upper bladder 114*b*. The second undulations 172*g*-172*j* are configured to receive the corresponding lobes 146*g*-146*j* of the upper bladder 114*b* and to be received within the channels 152*a*-152*d* of the lower bladder 112. Thus, the undulations 172*a*-172*d*, 172*g*-172*j* function as receptacles 172*a*-172*d*, 172*g*-172*j* for the corresponding lobes 146*a*-146*d*, 146*g*-146*j* of the bladders 112, 114*b*.

Figure 24:
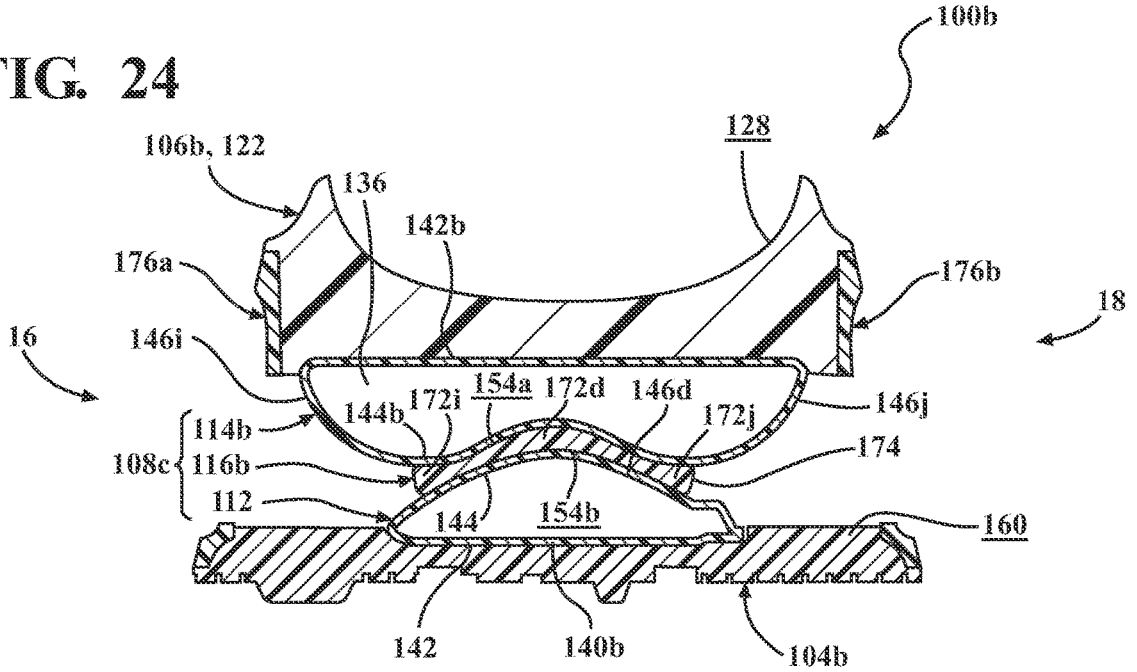
FIG. 24 is a cross-section view of the article of footwear of FIG. 17, taken along Line 24-24 in FIG. 19.
Figure 25:
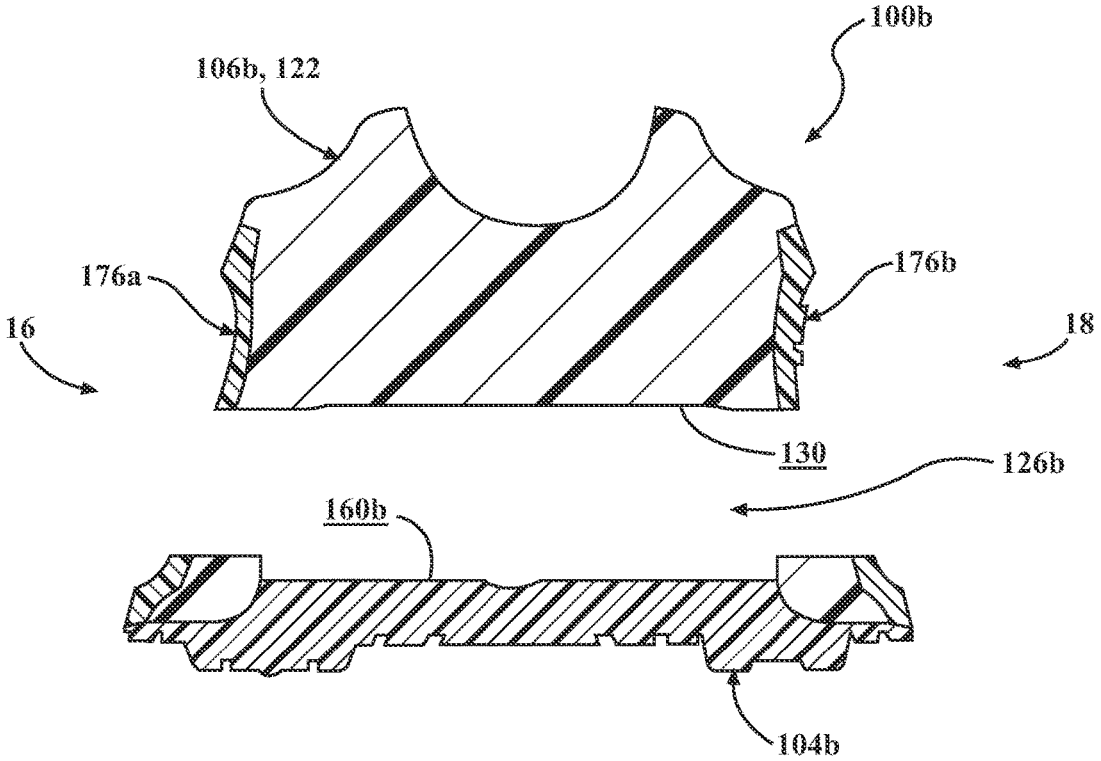
FIG. 25 is a cross-section view of the article of footwear of FIG. 17, taken along Line 25-25 in FIG. 19.

A diameter of the outer periphery 174 of the support plate 116*b* may also be undulated such that portions of the outer periphery 174 corresponding to the first undulations 172*a*-172*d* terminate at the distal ends of the lobes 146*a*-146*d* of the lower bladder 112 (FIGS. 20 and 23) and portions of the outer periphery 174 corresponding to the second undulations 172*g*-172*j* terminate at the distal ends of the lobes 146*g*-146*j* of the upper bladder 114*b* (FIGS. 22 and 24). Thus, the peripheral rim 170 of the support plate 116*b* fills a space formed between inner portions of the bladders 112, 114*b*, while the outer portions of the bladders 112, 114*b* are exposed and unrestricted.

With continued reference to FIGS. 20-24, the cushioning arrangement 108*c* is disposed within the recess 126 of the chassis 106 such that a first end of the cushioning arrangement 108*c* formed by the base barrier layer 142*b* of the upper bladder 114*b* is received within the upper socket 136 of the footbed 122 and a second end of the cushioning arrangement 108*c* formed by the base barrier layer 142 of the lower bladder 112 is received within a lower socket 140*b* formed in the inner surface 160*b* of the outsole 104*b*. Thus, in this example, cradle 110 is omitted and the cushioning arrangement 108*c* is attached directly to the outsole 104*b*.

As shown, the cushioning arrangement 108*c* is oriented within the recess 126 such that a first pair of opposing lobes 146*a*, 146*c* of the lower bladder 112 are aligned with the longitudinal axis $A_{10c}$ and the second pair of opposing lobes 146*b*, 146*d* of the lower bladder 112 are aligned across the longitudinal axis $A_{10c}$. Conversely, the upper bladder 114*b* is oriented such that a first pair of adjacent lobes 146*g*, 146*i* are aligned with the longitudinal axis $A_{10}$ along the lateral side 16 and a second pair of adjacent lobes 146*h*, 146*j* are aligned with the longitudinal axis $A_{10}$ along the medial side 18.

When the heel region 24 of the sole structure 100*b* is compressed, the compression forces applied to the cushioning arrangement 108*c* are distributed among the inner portions of the bladders 112, 114*b*. Particularly, the support plate 116*b* distributes the compression forces among the inner portions of the lobes 146*a*-146*d*, 146*g*-146*j*. Because the support plate 116*b* fills the spaces formed between the inner portions of the bladders 112, 114*b*, the interior depressions 148, 148*b* of the bladders 112, 114*b* do not deform to accommodate the pressure increase within the bladders 112, 114*b*. In this example, the increased pressure within the compressed bladders 112, 114*b* is accommodated by the exposed outer portions of the lobes 146*a*-146*d*, 146*g*-146*j*. Thus, the rotated and stacked configuration of the cushioning arrangement 108*c* may result in a cushioning arrangement 108*c* with a firmer feel than the cushioning arrangements discussed above, as deformation of the cushioning barrier layers 142, 144*b* is restricted by the support plate 116*b*.

Optionally, the midsole 102 may include a pair of braces 176*a*, 176*b* surrounding openings of the recess 126*c* on opposite sides 16, 18 of the sole structure 100*b*. The braces 176*a*, 176*b* may be formed of a material having a greater hardness than the material of the chassis 106, such that the braces 176*a*, 176*b* provide added strength around the openings of the recess 126*b*.

Figure 26A:
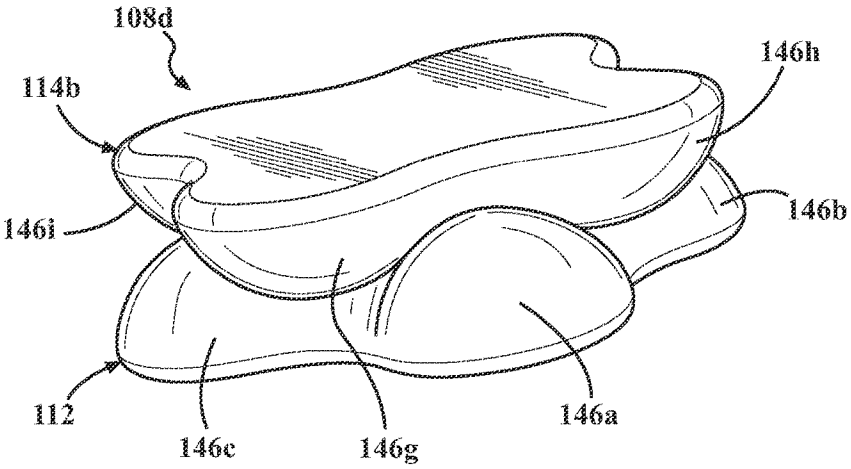
FIGS. 26A and 26B are perspective views of an example of an alternative cushioning arrangement for the article of footwear of FIG. 17.
Figure 26B:
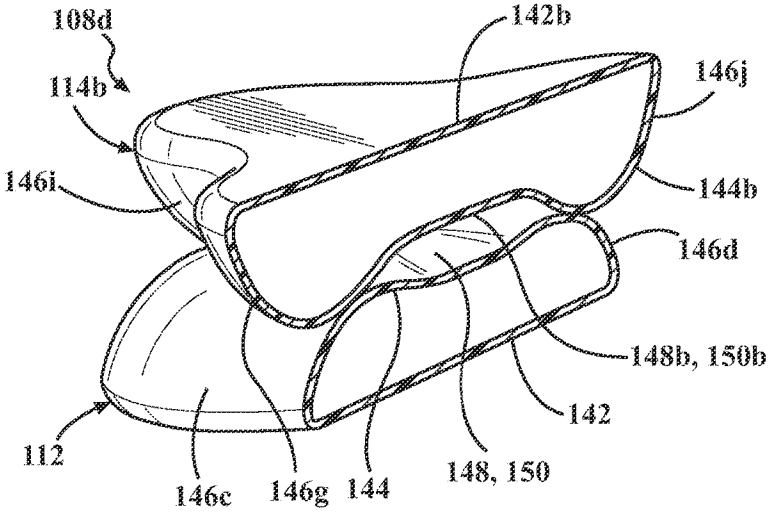

With particular reference to FIGS. 23A and 26B, a cushioning arrangement 108*d* is provided and includes the upper cushioning element 114*b* and the lower cushioning element 112 described above. In view of the substantial similarity in structure and function of the components associated with the cushioning arrangement 108 with respect to the cushioning arrangement 108*d*, like reference numerals are used hereinafter and in the drawings to identify like components while like reference numerals containing letter extensions are used to identify those components that have been modified.

The cushioning arrangement 108*d* of FIGS. 26A and 26B is substantially similar to the cushioning arrangement 108*b* previously described. However, in this configuration, the support plate 116*b* is omitted from the cushioning arrangement 108*c* such that the cushioning barrier layers 144, 144*b* mate directly with each other. As shown in FIG. 26B, the direct relationship between the bladders 112, 114*b* results in line-contact between the lobes 146*a*-146*d*, 146*g*-146*j* and the corresponding channels 152*g*-152*j*, 152*a*-152*d*. Additionally, the central portions 150, 150*b* of the bladders 112, 114*b* are spaced apart from each other. Accordingly, the cushioning arrangement 108*d* may have a softer feel than a cushioning arrangement 108*b* having the same interior void pressure, as deformation of the barrier layers 144, 144*b* of the cushioning arrangement 108*d* is not restricted by the support plate 116*b*.

Figure 27A:
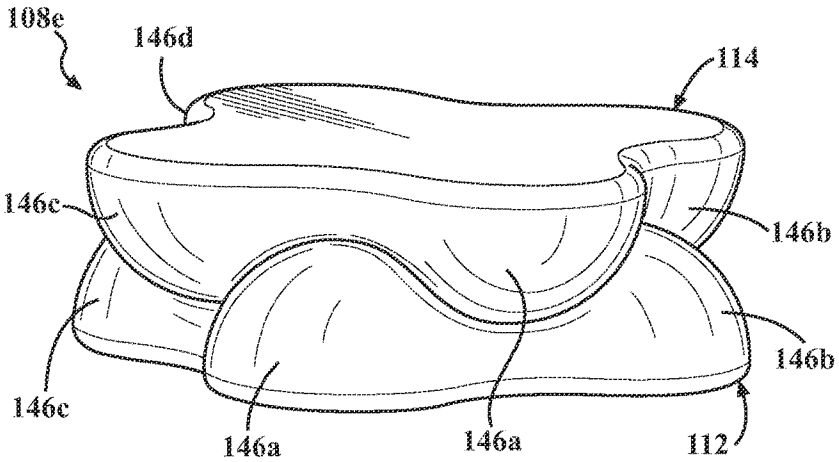
FIGS. 27A and 27B are perspective views of another example of an alternative cushioning arrangement for the article of footwear of FIG. 17.
Figure 27B:
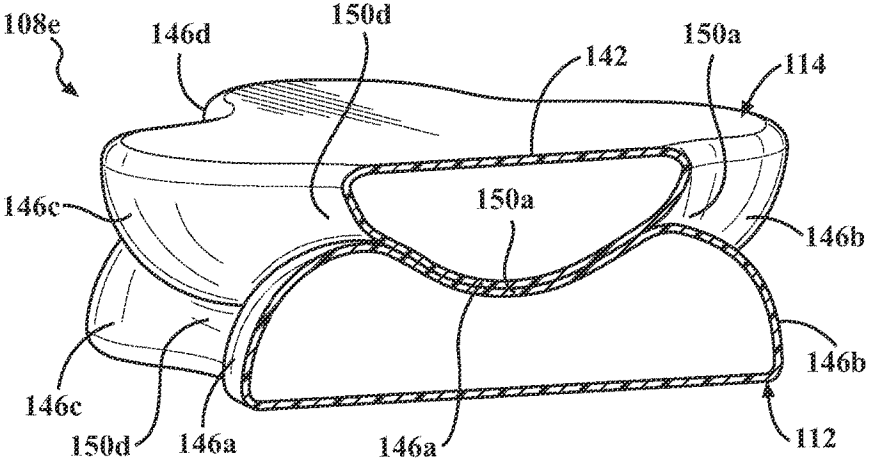

With particular reference to FIGS. 27A and 27B, a cushioning arrangement 108*e* is provided and includes the upper cushioning element 114 and the lower cushioning element 112. In view of the substantial similarity in structure and function of the components associated with the cushioning arrangement 108 with respect to the cushioning arrangement 108*e*, like reference numerals are used hereinafter and in the drawings to identify like components while like reference numerals containing letter extensions are used to identify those components that have been modified.

The cushioning arrangement 108*e* of FIGS. 27A and 27B is substantially similar to the cushioning arrangement 108*d* previously described. However, in this configuration, the bladders 112, 114 are the same size as each other and are configured such that an inner region (i.e., radially inwardly of the distal ends of the lobes 146*a*-146*d*) of the cushioning barrier layers 144 are in facing contact with each other. Thus, the bladders 112, 114 have a surface-contact bonding area, which provides greater stability and a firmer feel in comparison to the line-contact bonding of the cushioning arrangement 108*d*.

With particular reference to FIGS. 28-33, an article of footwear 10*c* is provided and includes a sole structure 100*c* and the upper 200 attached to the sole structure 100*c*. In view of the substantial similarity in structure and function of the components associated with the article of footwear 10 with respect to the article of footwear 10*c*, like reference numerals are used hereinafter and in the drawings to identify like components while like reference numerals containing letter extensions are used to identify those components that have been modified.

Figure 28:
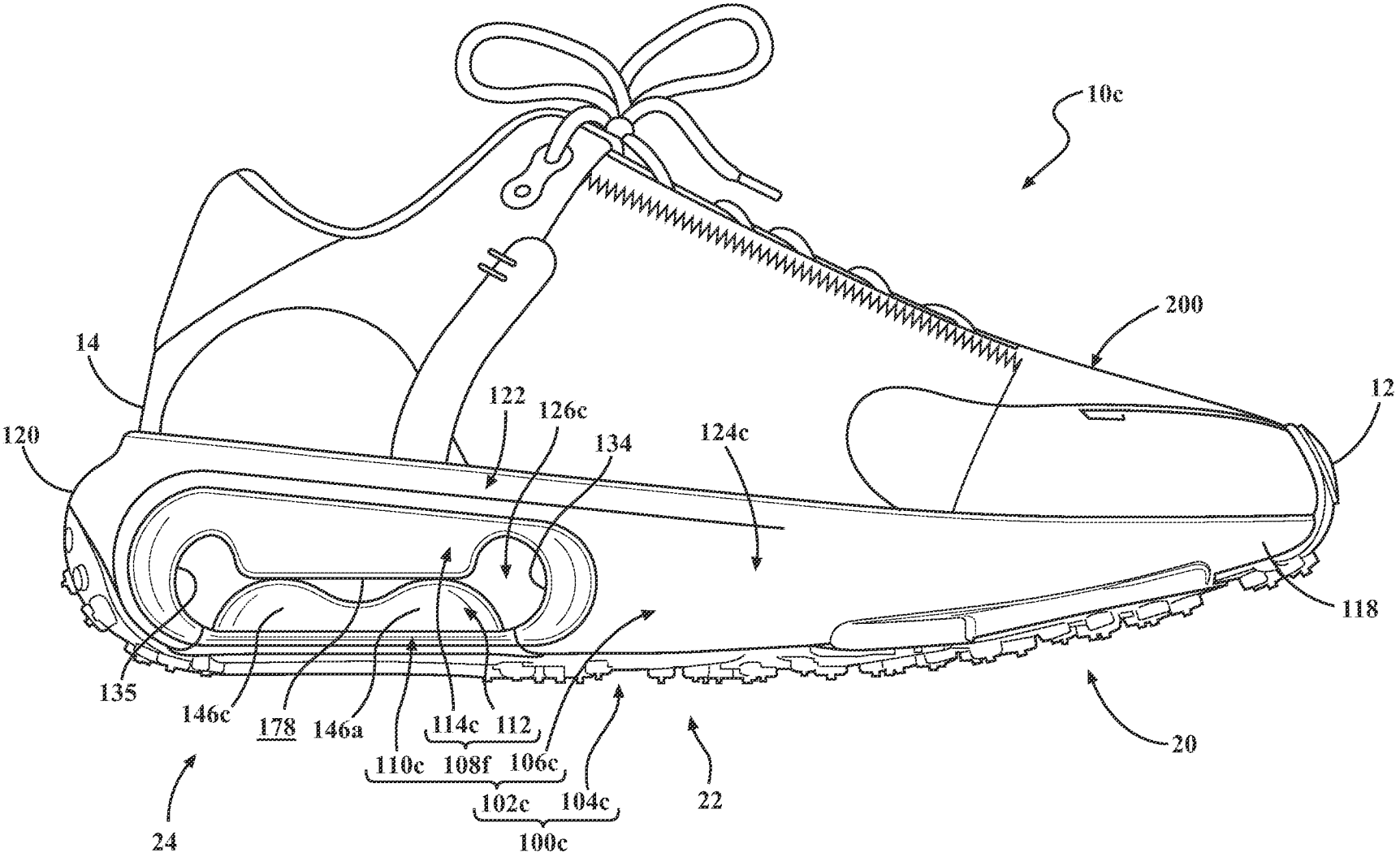
FIG. 28 is a lateral side elevation view of an article of footwear including a sole structure in accordance with the principles of the present disclosure.
Figure 29:
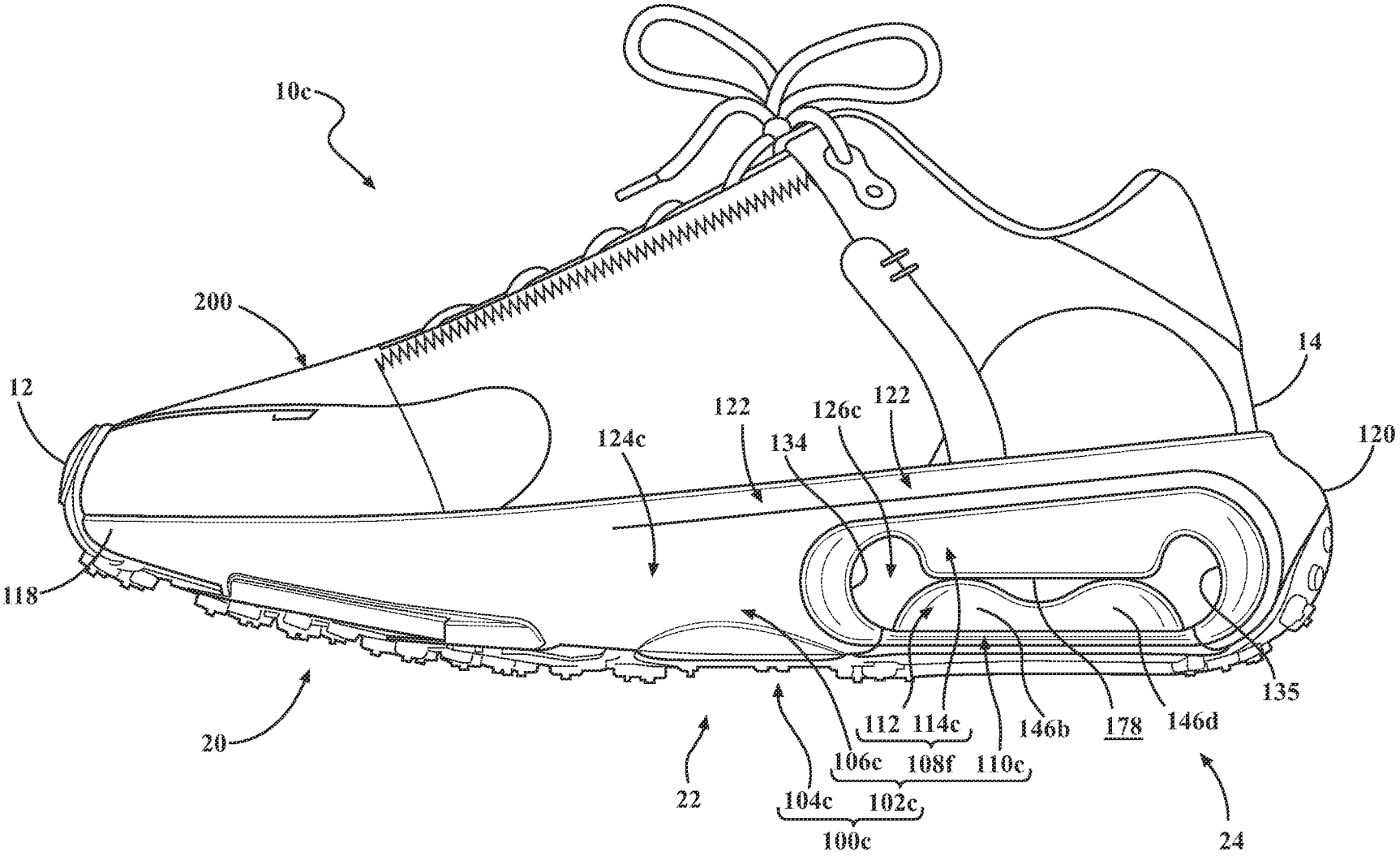
FIG. 29 is a medial side elevation view of the article of footwear of FIG. 28.
Figure 30:
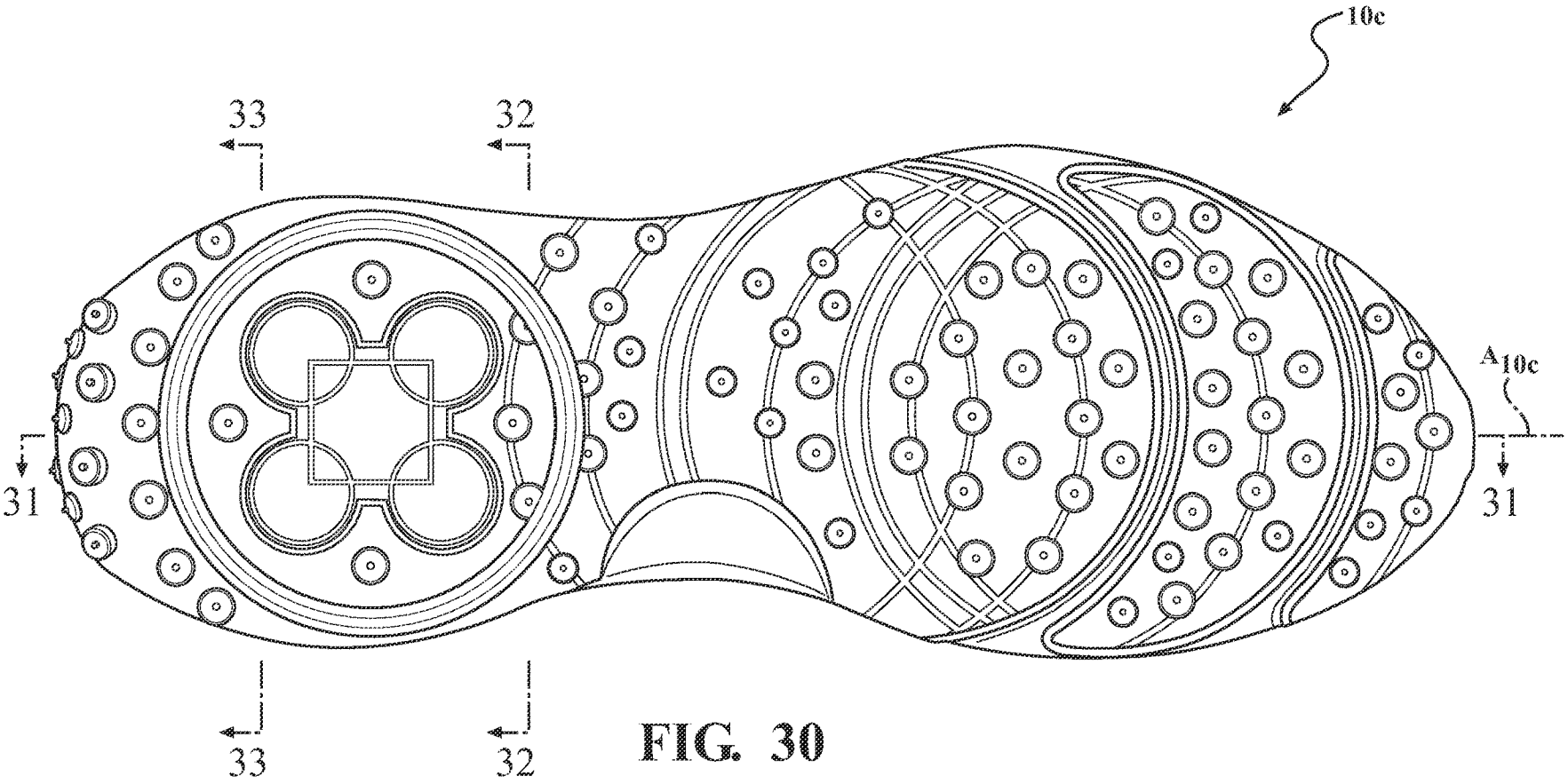
FIG. 30 is a bottom plan view of the article of footwear of FIG. 28.
Figure 31:
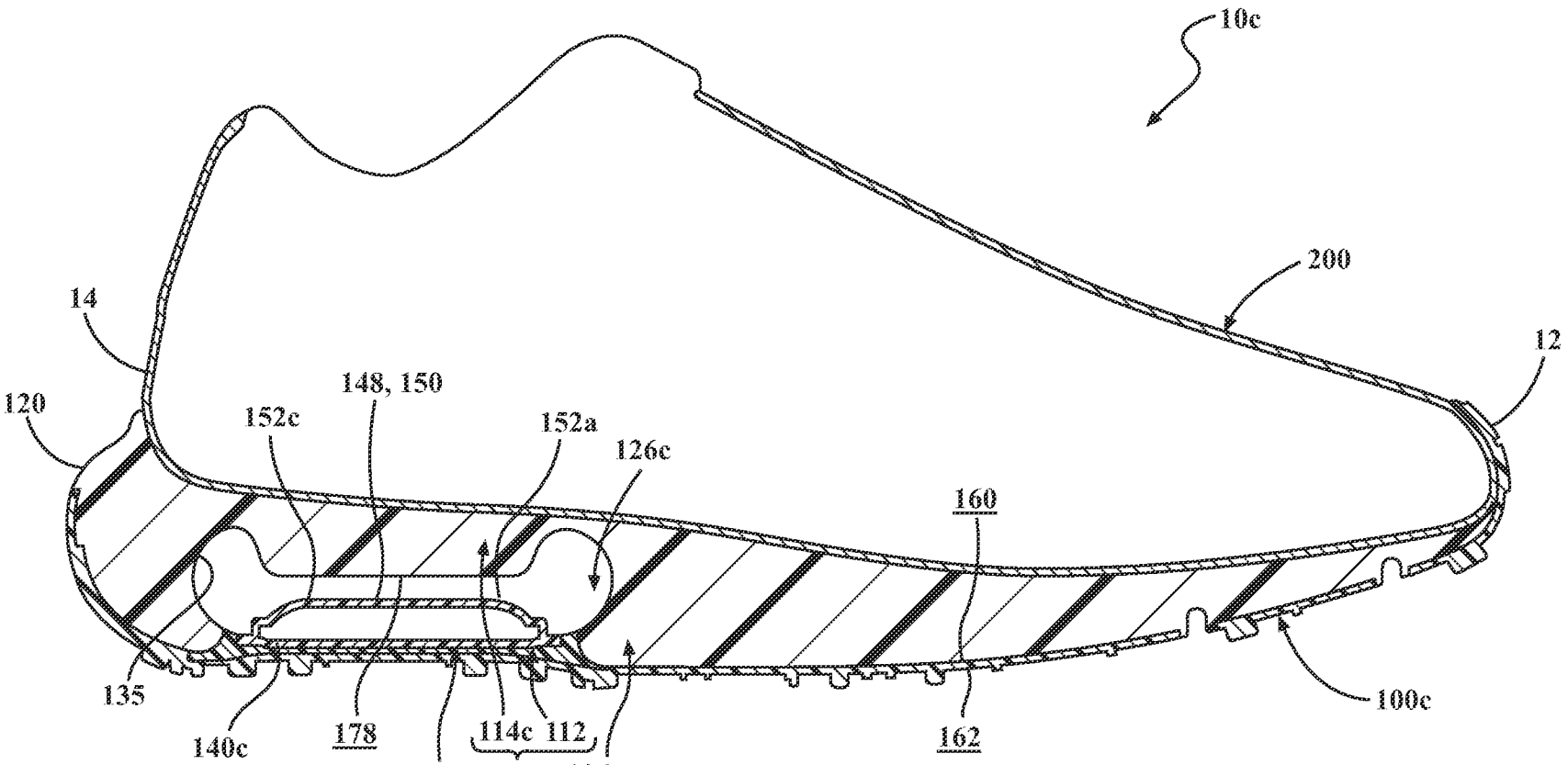
FIG. 31 is a cross-section view of the article of footwear of FIG. 28, taken along Line 31-31 in FIG. 30.
Figure 32:
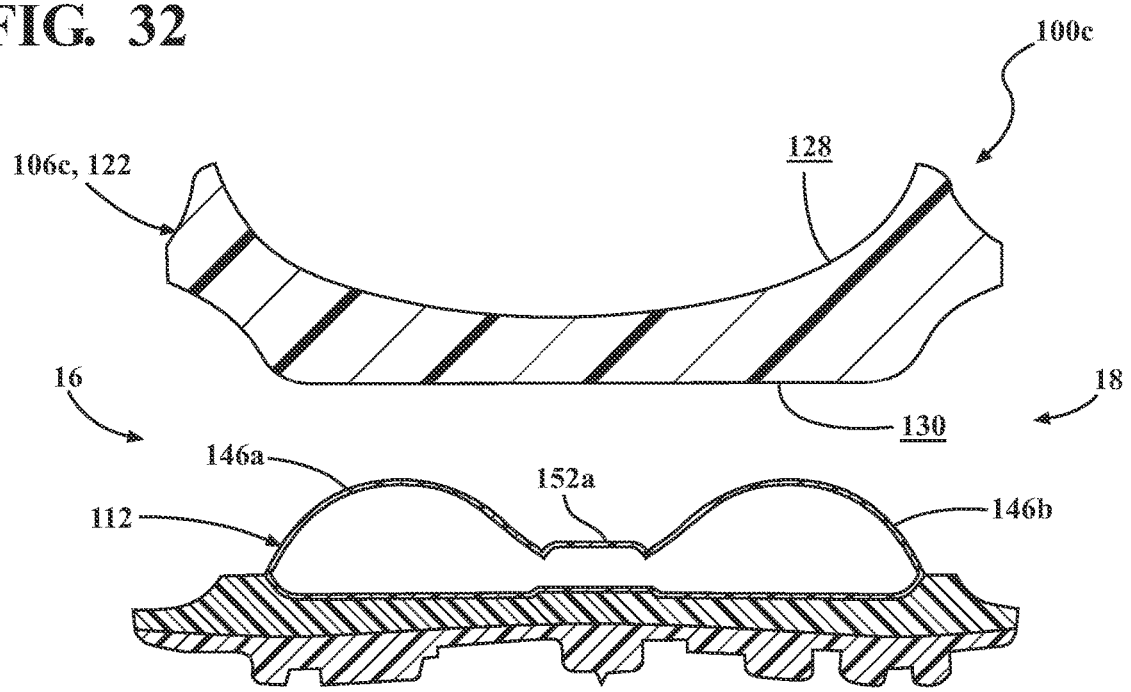
FIG. 32 is a cross-section view of the article of footwear of FIG. 28, taken along Line 32-32 in FIG. 30.
Figure 33:
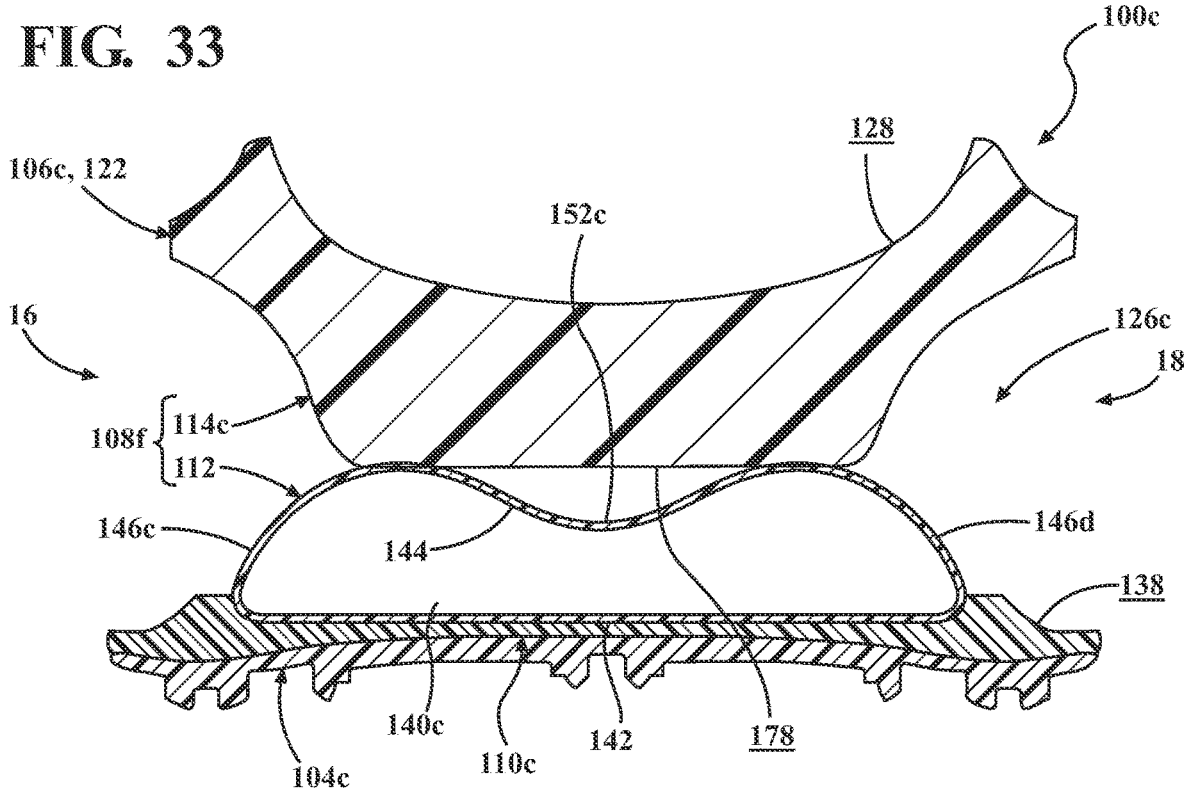
FIG. 33 is a cross-section view of the article of footwear of FIG. 28, taken along Line 33-33 in FIG. 30.

As shown in FIGS. 28 and 29, the article of footwear 10*c* includes a sole structure 100*c* having a midsole 102*c* and an outsole 104*c*. The midsole 102*c* includes a chassis 106*c* having the footbed 122 formed in an upper portion and a forefoot support member 124*c* and recess 126*c* formed on a lower portion. The midsole 102*b* further includes a cushioning arrangement 108*f* received within the recess 126*c* of the chassis 106*c*, between the footbed 122*c* and the outsole 104*c*. In this example, the midsole 102*c* includes a cradle 110*c* extending across a lower portion of the recess 126*c* between the cushioning arrangement 108*f* and the outsole 104*c*. The cradle 110*c* includes a lower socket 140*c* configured to receive an end of the cushioning arrangement 108*f*.

The cushioning arrangement 108*f* of the present example includes the lower cushioning element 112 formed as a bladder 114, as previously described, and an upper cushioning element 114*c* including a resilient polymeric material. As shown, the upper cushioning element 114*c* is formed as a foam cushioning element 114*c* attached to and extending from the lower surface 130 of the footbed 122. Here, the upper cushioning element 114*c* extends from the lower surface 130 to a substantially planar distal end surface 178 facing the lower bladder 112. In the illustrated example, the upper cushioning element 114*c* is integrally formed with the footbed 122*c* of the chassis 106. Thus, the upper cushioning element 114*c* and the footbed 122*c* may include the same foam material. However, in other examples, the upper cushioning element 114*c* may be formed separately from the footbed 122*c* and/or include different resilient materials than the footbed 122*c*.

When the sole structure 100 is assembled, the distal ends of the lobes 146*a*-146*d* of the lower bladder 112 form respective point-contacts with the planar distal end 178 of the upper cushioning element 114*c*. Thus, when the heel region 24 is compressed during use, the lobes 146*a*-146*d* of the lower bladder 112 are compressed by the resilient distal end 178 of upper cushioning element 114.

The following Clauses provide exemplary configurations for an article of footwear, a bladder for an article of footwear, or a sole structure for an article of footwear described above.

Clause 1: A sole structure for an article of footwear, the sole structure including a chassis including a recess formed between a first surface and a second surface facing the first surface, and a cushioning arrangement including a first cushioning element protruding from the first surface and including a plurality of lobes and a second cushioning element protruding from the second surface to a distal end contacting the plurality of lobes.

Clause 2: The sole structure of Clause 1, wherein the first cushioning element includes a bladder.

Clause 3: The sole structure of Clause 1 or 2, wherein a first side of the first cushioning element includes a substantially planar base and a second side of the first cushioning element includes the plurality of lobes formed on an opposite side from the base.

Clause 4: The sole structure of any one of Clauses 1-3, wherein lobes of the plurality of lobes are arranged in a quad-shaped configuration.

Clause 5: The sole structure of any one of Clauses 1-4, wherein each lobe of the plurality of lobes is hemispherical.

Clause 6: The sole structure of any one of Clauses 1-5, wherein the first surface includes a first socket receiving a first end of the cushioning arrangement including the first cushioning element.

Clause 7: The sole structure of any one of Clauses 1-6, further comprising a cradle defining the first surface of the recess, the cradle including a harder material than the chassis.

Clause 8: The sole structure of any one of Clauses 1-7, wherein a length of the recess extends between a first concave end and a second concave end.

Clause 9: The sole structure of any one of Clauses 1-8, further comprising a support plate disposed between the first cushioning element and the second cushioning element and including a plurality of receptacles receiving the plurality of lobes of the first cushioning element.

Clause 10: The sole structure of Clause 9, wherein the support plate includes a material having a greater hardness than each of the first cushioning element and the second cushioning element.

Clause 11: A sole structure for an article of footwear, the sole structure comprising a chassis including a recess formed between a first surface and a second surface facing the first surface, and a cushioning arrangement including a first cushioning element protruding from the first surface and including a first plurality of lobes, and a second cushioning element protruding from the second surface and including a second plurality of lobes contacting the first plurality of lobes.

Clause 12: The sole structure of Clause 11, wherein at least one of the first cushioning element and the second cushioning element includes a fluid-filled bladder.

Clause 13: The sole structure of Clause 11 or 12, wherein a first side of the first cushioning element includes a substantially planar first base and the second cushioning element includes a substantially planar second base, the first plurality of lobes disposed on an opposite side of the first cushioning element than the substantially planar first base and the second plurality of lobes disposed on an opposite side of the second cushioning element than the substantially planar second base.

Clause 14: The sole structure of any one of Clauses 11-13, wherein lobes of the first plurality of lobes and lobes of the second plurality of lobes are arranged in a quad-shaped configuration.

Clause 15: The sole structure of any one of Clauses 11-14, wherein each lobe of the first plurality of lobes and each lobe of the second plurality of lobes is hemispherical.

Clause 16: The sole structure of any one of Clauses 11-15, wherein the first surface includes a first socket receiving the first cushioning element and the second surface includes a second socket receiving the second cushioning element.

Clause 17: The sole structure of any one of Clauses 11-16, further comprising a cradle defining the first surface of the recess, the cradle including a harder material than the chassis.

Clause 18: The sole structure of any one of Clauses 11-17, wherein a length of the recess extends between a first concave end and a second concave end.

Clause 19: The sole structure of any one of Clauses 11-18, further comprising a support plate disposed between the first cushioning element and the second cushioning element and including a plurality of receptacles receiving lobes of the first cushioning element and lobes of the second cushioning element.

Clause 20: The sole structure of Clause 19, wherein the support plate includes a material having a greater hardness than each of the first cushioning element and the second cushioning element.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A sole structure for an article of footwear, the sole structure comprising:

a chassis including a recess formed between a first surface and a second surface facing the first surface;

a cushioning arrangement including a first cushioning element protruding from the first surface and including a plurality of lobes and a second cushioning element protruding from the second surface to a distal end; and a support plate disposed between the first cushioning element and the second cushioning element, the support plate including a material having a greater hardness than each of the first cushioning element and the second cushioning element and a series of receptacles each having an arcuate surface that matingly receives a respective arcuate surface of the plurality of lobes.

2. The sole structure of claim 1, wherein the first cushioning element includes a bladder.

3. The sole structure of claim 1, wherein a first side of the first cushioning element includes a substantially planar base and a second side of the first cushioning element includes the plurality of lobes formed on an opposite side from the base.

4. The sole structure of claim 1, wherein lobes of the plurality of lobes are arranged in a quad-shaped configuration.

5. The sole structure of claim 1, wherein each lobe of the plurality of lobes is hemispherical.

6. The sole structure of claim 1, wherein the first surface includes a first socket receiving a first end of the cushioning arrangement including the first cushioning element.

7. The sole structure of claim 1, further comprising a cradle defining the first surface of the recess, the cradle including a harder material than the chassis.

8. The sole structure of claim 1, wherein a length of the recess extends between a first concave end and a second concave end.

9. A sole structure for an article of footwear, the sole structure comprising:

a chassis including a recess formed between a first surface and a second surface facing the first surface;

a cushioning arrangement including a first cushioning element protruding from the first surface and including a first plurality of lobes, and a second cushioning element protruding from the second surface and including a second plurality of lobes; and a support plate disposed between the first cushioning element and the second cushioning element, the support plate including a material having a greater hardness than each of the first cushioning element and the second cushioning element and a series of receptacles each having an arcuate surface that matingly receives a respective arcuate surface of each of the first plurality of lobes and the second plurality of lobes.

10. The sole structure of claim 9, wherein at least one of the first cushioning element and the second cushioning element includes a fluid-filled bladder.

11. The sole structure of claim 9, wherein a first side of the first cushioning element includes a substantially planar first base and the second cushioning element includes a substantially planar second base, the first plurality of lobes disposed on an opposite side of the first cushioning element than the substantially planar first base and the second plurality of lobes disposed on an opposite side of the second cushioning element than the substantially planar second base.

12. The sole structure of claim 9, wherein lobes of the first plurality of lobes and lobes of the second plurality of lobes are arranged in a quad-shaped configuration.

13. The sole structure of claim 9, wherein each lobe of the first plurality of lobes and each lobe of the second plurality of lobes is hemispherical.

14. The sole structure of claim 9, wherein the first surface includes a first socket receiving the first cushioning element and the second surface includes a second socket receiving the second cushioning element.

15. The sole structure of claim 9, further comprising a cradle defining the first surface of the recess, the cradle including a harder material than the chassis.

16. The sole structure of claim 9, wherein a length of the recess extends between a first concave end and a second concave end.

* * * * *